US005913703A

United States Patent [19]

Suzuki et al.

[11] Patent Number: 5,913,703

[45] Date of Patent: Jun. 22, 1999

[54] CONNECTOR ASSEMBLY WITH SEQUENTIALLY ENGAGEABLE HOUSINGS

[75] Inventors: Masaji Suzuki; Hitoshi Okumura; Toshikazu Sakurai; Shuji Kosuge; Akihito Maegawa, all of Yokkaichi, Japan

[73] Assignee: Sumitomo Wiring Systems, Ltd., Japan

[21] Appl. No.: 08/843,999

[22] Filed: Apr. 18, 1997

[30] Foreign Application Priority Data

Apr. 24, 1996 [JP] Japan ..... 8-102810
May 21, 1996 [JP] Japan ..... 8-125944

[51] Int. Cl.[6] ..... H01R 13/514

[52] U.S. Cl. ..... 439/701; 439/489

[58] Field of Search ..... 439/489, 701, 439/924.1, 677, 680, 378

[56] References Cited

U.S. PATENT DOCUMENTS 5,151,048 9/1992 Sato ..... 439/489
5,344,347 9/1994 Inoue et al. ..... 439/701
5,470,251 11/1995 Sano ..... 439/489

FOREIGN PATENT DOCUMENTS 0 657 968 6/1995 European Pat. Off. .

*Primary Examiner*—Steven L. Stephan
*Assistant Examiner*—Eugene G. Byrd
*Attorney, Agent, or Firm*—Anthony J. Casella; Gerald E. Hespos; Ludomir A. Budzyn

[57] ABSTRACT

A divided connector is provided to reduce engaging forces and to enable a simplified engagement detection. The connector has male and female connector housings 1, 2; 51, 60 each carrying a group of terminal fittngs 7, 7*a*, 12. Either one of the connector housings 1, 2; 51, 60 is divided into a plurality of housing pieces 3, 4; 61, 62, 63 so as to be fittable and engageable with a plurality of corresponding accommodation positions in the other connector housing 1, 2; 51, 60. The connector has a controller 14–16; 18–25; 45, 47, 48; 65–74; 114–124 for controlling the fitting and/or engagement of a previously fitted and/or engaged housing piece 3, 4; 61, 62, 63, and engagement detector means 7*a*, 27–43 for detecting whether or not the last housing piece 3, 4; 61, 62, 63 was properly engaged.

15 Claims, 18 Drawing Sheets

CONNECTOR ASSEMBLY WITH SEQUENTIALLY ENGAGEABLE HOUSINGS

BACKGROUND OF THE INVENTION

1. Field of the Invention

The present invention relates to a connector of divided type provided with an engagement detecting function.

2. Description of the Prior Art

In recent years, there has been an increasing tendency that connectors used for a wiring harness of an automotive vehicle have more and more electrical connections. Such multi-connection connectors require a large engaging force if an attempt is made to engage mating male and female connector housings at one time. As a countermeasure for such a requirement, connectors of so-called divided type are used in which one connector housing is divided into a plurality of housing pieces which are successively engaged with the mating connector housing to reduce an engaging force required. On the other hand, particularly in essential circuits such as a circuit for an air bag, short-circuiting terminals or the like are used to accurately detect whether or not the connector is properly engaged.

If the above engagement detection is made in the divided type connector, it is necessary to provide a short-circuiting terminal and make a detection for each housing piece. This disadvantageously leads to an increase in the number of parts and a cumbersome operation, and therefore to an increased production cost.

The present invention was developed in view of the above problem, and an object thereof is to provide a connector which is of divided type to reduce an engaging force and enables the realization of a simplified engagement detection.

SUMMARY OF THE INVENTION

In order to accomplish the above object, the invention is directed to a connector comprising male and female connector housing each carrying a group of terminal fittings. Either one of the connector housings is divided into a plurality of housing pieces so as to be fittable and engageable with a plurality of corresponding accommodation positions in the other connector housing. The connector further comprises control means for controlling the fitting and/or engagement of a previously fitted and/or engaged housing piece, and engagement detecting means for detecting whether or not the last housing piece was properly engaged.

The successively fitting and/or engaging of the housing pieces is such, that the succeeding housing piece is fittable and/or engageable, while it is controlled whether one or more of previous housing pieces are properly fitted and/or engaged. Accordingly, it is possible to make the fitting and/or engagement of one or preferably each housing piece dependent from the fitting and or engagement of one or more of the other housing pieces. Therefore, when the last housing piece is fitted and/or engaged, it can be discriminated whether all the preceding housing pieces are already properly fitted and/or engaged or not. Thus, by making a single detection as to whether the last housing piece is properly engaged, it can be known whether or not all housing pieces are properly engaged.

In other words, since it is sufficient to provide the engagement detecting means at the last housing piece, the number of parts can be reduced and the detection can be simplified. This leads to an advantage of a reduced production cost.

As a further advantage the inventive connector is able to handle with most versatile possibilities and timings of fitting and/or engagement of the different housing pieces as will be described later. Accordingly it is possible to use any arbitrarily chosen fitting and/or engagement order of the housing pieces, as the state of respective housing pieces is influenced or dependent from the state of other housing pieces.

Preferably the control means are fitting and/or engagement permitting means, and are provided for permitting the fitting and/or engagement of a succeeding housing piece only after a previous housing piece is properly fitted and/or engaged.

In successively fitting and/or engaging the housing pieces, the succeeding housing piece is fittable and/or engageable only after the previous housing piece is properly fitted and/or engaged. Accordingly, when the last housing piece is fitted and/or engaged, all the preceding housing pieces are already properly fitted and/or engaged. Therefore, by making a single detection as to whether the last housing piece is properly fitted and/or engaged, it is known whether or not all housing pieces are properly fitted and/or engaged.

Accordingly, preferred and most simple fitting and/or engagement orders, when considering a connector housing divided in two housing pieces are such, that:

the fitting of the second housing piece is only permitted when the first housing piece is properly fitted;

the fitting of the second housing piece is only permitted when the first housing piece is properly engaged;

the engagement of the second housing piece is only permitted when the first housing piece is properly fitted;

the engagement of the second housing piece is only permitted when the first housing piece is properly engaged;

the engagement of the first housing piece is only permitted when the second housing piece is properly fitted;

the engagement of the first housing piece is only permitted when the second housing piece is properly engaged.

It is to be understood, that the above is only to be considered as possible examples, and that when using more than two housing pieces a large versatility arises.

According to a particularly preferred embodiment the connector, comprising male and female connector housing each carrying a group of terminal fittings, either one of the connector housings being divided into a plurality of pieces so as to be fittable into a plurality of accommodation positions in the other connector, comprises:

engagement permitting means for permitting the engagement of a succeeding housing piece only after a previous housing piece is properly engaged, and engagement detecting means provided at a last housing piece for detecting whether or not the last housing piece was properly engaged.

Accordingly, in successively engaging the housing pieces, the succeeding housing piece is fittable only after the previous housing piece is properly engaged. When the last housing piece is engaged, all the preceding housing pieces are already properly engaged. Therefore, by making a single detection as to whether the last housing piece is properly engaged, it is known whether or not all housing pieces are properly engaged.

In other words, since it is sufficient to provide the engagement detecting means at the last housing piece, the number of parts can be reduced and the detection can be simplified. This leads to an advantage of a reduced production cost.

Preferably the control means, are assisting means and provided for pushing a previously fitted and/or engaged housing piece by a pushing force of a subsequently fitted housing piece, In successively fitting and/or engaging the housing pieces, even if one of the previous housing pieces is insufficiently fitted and/or engaged, this housing piece is pressed to its proper fitting and/or engagement position by the subsequent housing piece. Accordingly, a subsequent housing piece is able to influence or to handle the fitting and/or engagement of one or more of preceding housing pieces. Thus, when the last housing piece is fitted and/or engaged, it can be ensured, that all preceding housing pieces already are fitted properly and/or engaged. Therefore, by making a single detection as to whether the last housing piece is properly fitted and/or engaged, it can be known whether or not all housing pieces are fitted properly and/or engaged.

It is further preferred, that the control means, in particular assisting means, are provided between housing pieces to be adjacent to each other.

Accordingly the subsequent housing piece influences or handles only the adjacent preceding housing piece. Therefore, by making a single detection as to whether the last housing piece is properly fitted and/or engaged, it is known whether or not all housing pieces are properly fitted and/or engaged.

According to a particularly preferred embodiment the connector, comprising male and female connector housings each carrying a group of terminal fittings, either one of the connector housings being divided into a plurality of housing pieces so as to be fittable into a plurality of accommodation positions in the other connector, comprises:

assisting means provided between housing pieces to be adjacent to each other for pushing a previously fitted housing piece by a pushing force of a subsequently fitted housing piece, and engagement detecting means provided in the housing piece to be engaged last for detecting whether or not the last housing piece has been engaged properly.

In successively engaging the housing pieces, in this preferred embodiment, even if the previous housing piece is insufficiently engaged, this housing pieces is pressed to its proper engagement position by the subsequent housing piece. Accordingly, when the last housing piece is engaged, all the preceding housing pieces are already properly engaged. Therefore, by making a single detection as to whether the last housing piece is properly engaged, it is known whether or not all housing pieces are properly engaged.

Preferably there is further provided an elastically deformable lock member provided at a side wall of a, in particular each, previous housing piece to be adjacent to the subsequent housing piece, wherein the lock member is elastically deformable by moving onto a locking portion provided at the mating connector housing as the previous housing piece is fitted; restores its configuration to be engaged with the locking portion upon the proper engagement of the previous housing piece; and, while being deformed by moving onto the locking portion, projects into an fitting and/or engagement area of one of the subsequent housing pieces so as to be pressed by the subsequent housing piece.

The previous housing piece is fitted while the lock member is elastically deformed by moving onto the locking portion. If one of the previous housing pieces is left insufficiently fitted and/or engaged, since the lock member is projecting into the fitting and/or engagement area of the subsequent housing piece, the previous housing piece is pressed to its proper fitting and/or engagement position via the lock member to be locked in the mating connector housing as the subsequent housing piece is fitted. Thereafter, the engagement of the subsequent housing piece is continued. Likewise, before the last housing piece is engaged, all the preceding housing pieces are already properly engaged. Therefore, by making a single detection as to whether the last housing piece is properly engaged, it is known whether or not all housing pieces are properly engaged.

It should also be considered that the lock member can also be designed in order to be pressed by a later housing piece, in particular only by the last housing piece.

It is alternatively preferred, that there is further provided an elastically deformable lock member provided at a side wall of one, in particular each, previous housing piece to be adjacent to the subsequent housing piece, wherein the lock member is elastically deformable by moving onto a locking portion provided at the mating connector housing as the previous housing piece is fitted. The lock member then restores its configuration to be engaged with the locking portion upon the proper fitting and/or engagement of the previous housing piece. While being deformed by moving onto the locking portion, the lock member projects into a fitting and/or engagement area of one of the subsequent housing pieces so as to inhibit fitting and/or engagement of one of the subsequent housing pieces, in particular of each next housing piece.

The previous housing piece is fitted while the lock member is elastically deformed by moving onto the locking portion. If one or more of the previous housing pieces is left insufficiently fitted and/or engaged, since the lock member is projecting into the fitting and/or engagement area of one of the subsequent housing piece, the subsequent housing piece is not allowed to be fitted and/or engaged via the lock member. The fitting and/or engagement of the subsequent housing piece can only be continued after proper fitting and/or engagement of the previous or preceding housing piece or pieces. Likewise, the last housing piece can only be fitted and/or engaged, when all the preceding housing pieces are already properly fitted and/or engaged. Therefore, by making a single detection as to whether the last housing piece is properly fitted and/or engaged, it is known whether or not all housing pieces are properly fitted and/or engaged. Accordingly, it is possible to considerably increase the security of the connector.

Preferably the divided connector housing is such that an auxiliary housing piece is fittable and/or engageable with a main housing piece and/or the mating connector housing , said main housing piece being fittable and/or engageable with the mating connector housing. The auxiliary housing piece and/or said main housing piece can be partly locked with respect to each other and/or to said mating connector housing. The control means, in particular engagement permitting means act to permit the fitting and/or engagement of the auxiliary housing piece and/or of the main housing piece by releasing the partial lock only after the auxiliary housing piece and/or the main housing piece is/are properly fitted and/or engaged with each other and/or the mating connector housing.

Accordingly, it is also possible to make the fitting and/or engagement dependent from the state of the respective housing pieces with respect to each other. Thus, when considering the above cited fitting and/or engagement orders or timings for the first and second housing pieces, these are supplemented by the following further possibilities:

the fitting of the two housing pieces is only permitted when the two housing pieces are properly fitted with each other;

the engagement of the two housing pieces is only permitted when the two housing pieces are properly fitted with each other;

the fitting of the two housing pieces is only permitted when the two housing pieces are properly engaged with each other;

the engagement of the two housing pieces is only permitted when the two housing pieces are properly engaged with each other;

the fitting of one of the two housing pieces is only permitted when the two housing pieces are properly fitted with each other;

the engagement of one of the two housing pieces is only permitted when the two housing pieces are properly fitted with each other;

the fitting of one of the two housing pieces is only permitted when the two housing pieces are properly engaged with each other;

the engagement of one of the two housing pieces is only permitted when the two housing pieces are properly engaged with each other.

It is to be understood, that the auxiliary housing piece and the main housing piece, referred above as first and second housing piece can also be provided by a larger number. The possibilities enumerated above are also applicable accordingly. It is also to be understood, that the above is only to be considered as possible examples, and that when using more than two housing pieces a huge versatility arises.

It is further preferred, that the divided connector housing is such that an auxiliary housing piece is movably provided in a main housing piece along a direction of fitting and/or engagement with the mating connector housing and can be partly locked in a position with respect to, in particular in or before, the main housing piece with respect to the direction of fitting and/or engagement, the control means, in particular engagement permitting means act to permit the fitting and/or engagement of the main housing piece by releasing the partial lock only after the auxiliary housing piece is properly fitted and/or engaged.

In particular, when the divided connector housing is inserted or pressed into the mating connector housing, the auxiliary housing piece is first fitted. When the auxiliary housing piece is properly engaged, the main housing piece is fitted while being moved with respect to the auxiliary housing piece. The auxiliary housing piece is already properly engaged when the engagement of the main housing piece is started. Accordingly, the proper engagement of both housing pieces can be detected by making only a single detection as to whether the main housing piece is properly engaged. Since it is sufficient to provide the engagement detecting means only at the main housing piece, a production cost can be reduced by reducing the number of parts and simplifying the detection. Further, since the main housing piece and the auxiliary housing piece are so assembled as to be partly locked with each other, the connector can easily be handled.

It is preferred that the connector further comprises means for preventing unwanted self-locking during fitting and/or engagement of said housing pieces, in particular guide means or ribs for allowing smooth movement of the respective housings and/or housing pieces with respect to each other. The means for preventing unwanted self-locking or particularly suited when the respective housing pieces are relatively large, or in the case when solely the last housing piece influences or pushes one or more of the preceding housing pieces into their respective proper fitting and/or engagement positions. Additionally, the required fitting and/or engagement force for the respective fitting and/or engagement can advantageously be reduced. The reduction of required force also eliminates any risk of misinterpretation while fitting and/or engaging the respective housing pieces when the control means act to inhibit the fitting and/or engagement of any of said housing pieces. Further when locking means and/or a partial lock are provided the design thereof can be performed in a very simple way, requiring only small deformation and locking and/or releasing force amounts.

It is further preferred that indexing means are provided for preventing, fitting and/or engagement of an unsuitable or wrong housing piece with the respective accommodation position and/or with respect to the relation of different housing pieces to each other. It is possible to provide the means for preventing unwanted self-locking in a specific configuration so as to also act as indexing means. In particular when using projections on the mating connector housing and correspondingly formed recesses in the respective housing pieces a smooth fitting and/or engagement can be ensured, while excluding any risk of fitting and/or engaging an unsuitable housing piece.

Finally, it is preferred that the engagement detecting means is provided at the housing piece to be fitted and/or engaged last, in particular in the main housing piece and/or at the mating connector housing. Accordingly, the engagement detection can be performed simultaneously for all housing pieces during the fitting and/or engagement of the housing piece to be inserted last.

In summary it is to be noted that the invention is to provide a connector being able to handle most different combinations of housing pieces and/or housing pieces insertion, fitting and/or engagement timings and/or orders. Accordingly, it is to be understood that the different aspects can be combined at will with each other, and that the terms first and second housing piece, former and later, previous or preceding and subsequent housing pieces and auxiliary and main housing pieces shall be considered as exchangeable with each other. It is also to be considered that when no indication is given with respect to which counterpart the fitting and/or engagement is indicated, the preferable meaning shall be with respect to the mating connector housing; however, also fitting and/or engagement of respective housing pieces with each other shall also be embraced within the scope of invention.

According to the present invention, since it is sufficient to provide the engagement detecting means in the last housing piece, the number of parts can be reduced. Further, the detection can easily be made. Therefore, a production cost can advantageously be reduced.

The above and further objects, features and advantages of the present invention will become apparent to a person skilled in the art when reading the following detailed description of several preferred embodiments of the invention taking reference to the accompanying drawings. A person skilled in the art will recognize that the following embodiments are to be considered as simple explanatory embodiments which shall not be considered as restrictive.

DETAILED DESCRIPTION OF THE PREFERRED EMBODIMENTS

Hereafter, one embodiment of the invention is described with reference to FIGS. 1 to 9.

Figure 1:
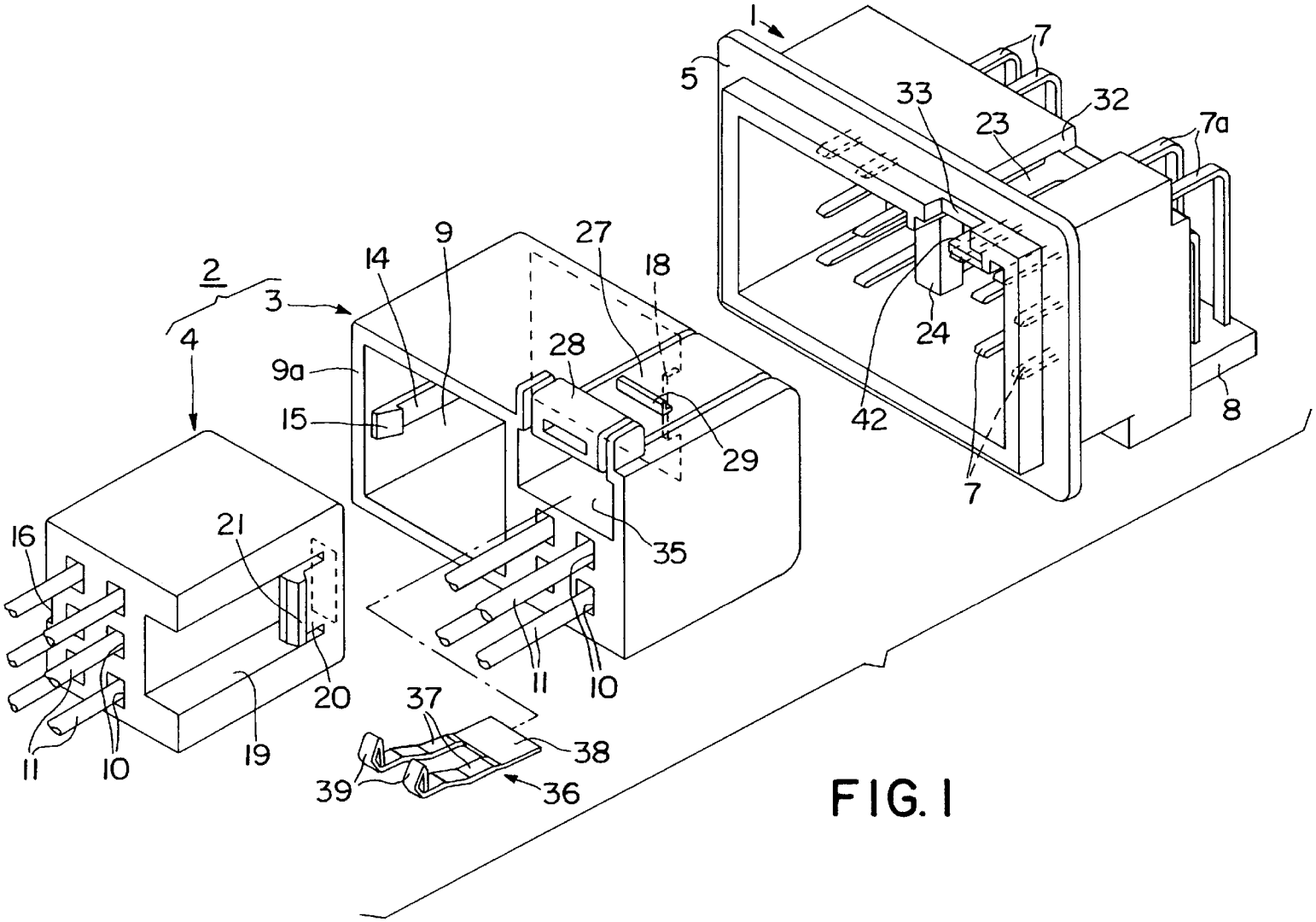
FIG. 1 is an exploded perspective view of a connector according to one embodiment of the invention.

In this embodiment, a connector for a printed circuit board (PCB) is shown. As shown in FIG. 1, this connector includes a male connector housing 1 (hereafter, merely "male housing") to be connected with a printed wiring board and a female connector 2 (hereafter, merely "female housing") to be fitted into the male housing 1. The female housing 2 is divided into a main housing piece 3 and an auxiliary housing piece 4.

Figure 7:
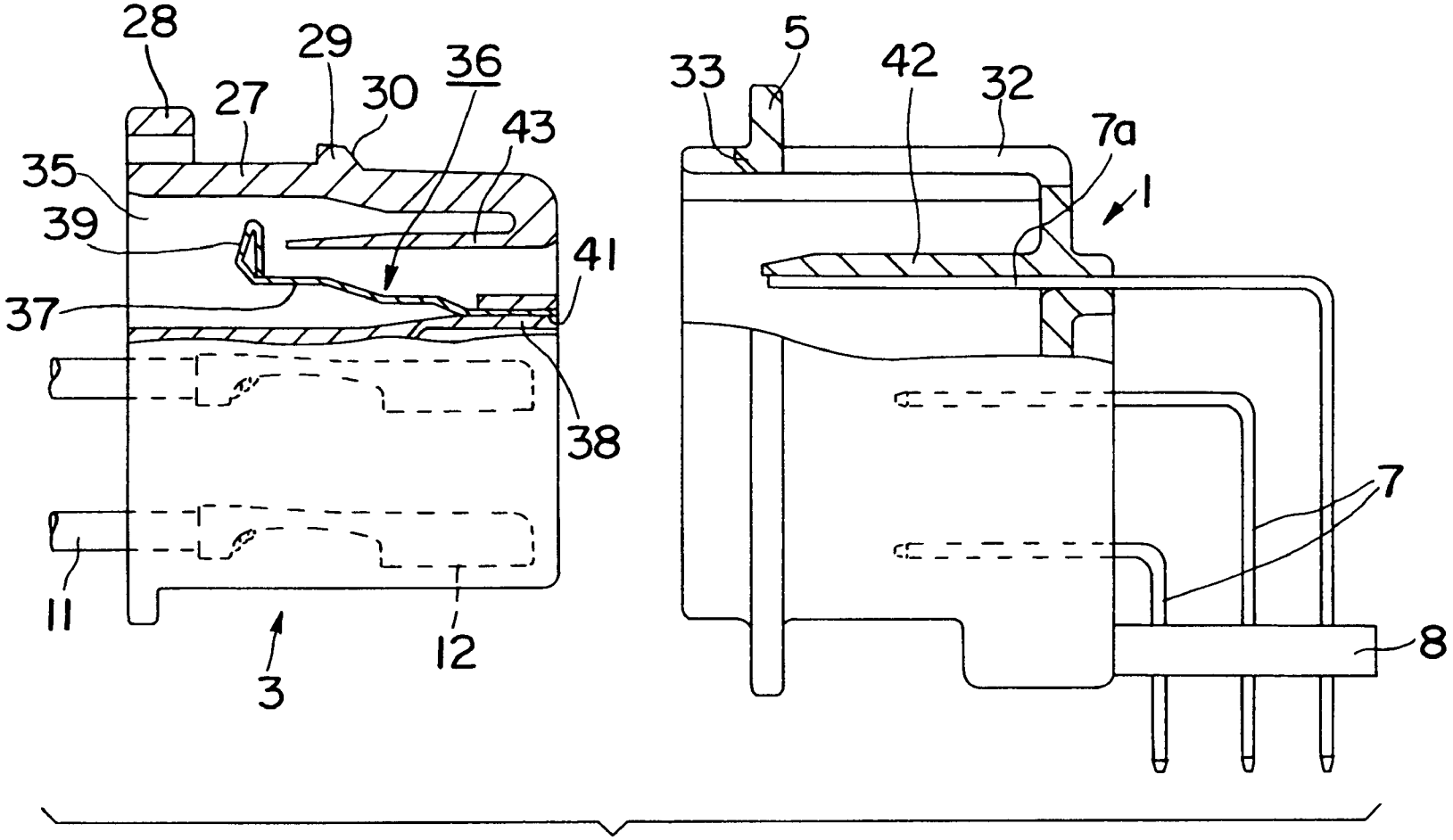
FIG. 7 is a side view partly in section showing a construction for the engagement detection.

The male housing 1 is made of synthetic resin into a boxlike shape having an open front surface at an engaging side. A jaw portion 5 is formed over the entire circumference of the outer surface of the male housing 1 at a front end. When viewed from front, the male housing 1 is divided into two areas: left and right areas. In each area, ends of six L-shaped male terminal fittings 7 project from the inner back surface while being arranged in two columns by three rows. The other ends of the respective male terminal fittings 7 project downward through an alignment plate 8 projecting at the bottom of the rear surface of the male housing 1 as shown in FIG. 7 so as to be connectable with contacts of an unillustrated printed wiring board. Two male terminal fittings in the uppermost row in the right area serve as detection terminals 7*a* for the engagement detection to be described in detail later.

The female housing 2 is similarly made of synthetic resin, and is constructed by the main housing piece 3 and the auxiliary housing piece 4 as described above. The main housing piece 3 is in the form of a block fittable into the male housing 1 and is formed with an accommodation space 9 for movably accommodating the auxiliary housing piece 4 along forward and backward directions at one side with respect to a widthwise direction (right side in FIG. 1). The accommodation space 9 is open in the front and rear surfaces of the main housing piece 3. On the other hand, four cavities 10 are arranged at a bottom portion of the front side of the main housing piece 3, and female terminal fittings 12 (see FIG. 2) secured to ends of wires 11 are accommodated in these cavities 10. The respective female terminal fittings 12 are individually connectable with four male terminal fittings 7 located at a lower side of the right area of the male housing 1.

Above the cavities 10, there is formed a mounting space 35 for mounting a short-circuiting terminal 36. A lock arm 27 for locking the engagement of the main housing piece 3 and the male housing 1 is provided on the ceiling surface of the mounting space 35. The lock arm 27 is described later.

The auxiliary housing piece 4 is in the form of a block fittable into the accommodation space 9 of the main housing piece 3. Six cavities 10 are arrayed in the auxiliary housing piece 4, and the female terminal fittings 12 secured to the ends of the wires 11 are similarly accommodated in these cavities 10. These female terminal fittings 12 are individually connectable with the six male terminal fittings in the left area of the male housing 1.

Figure 2:
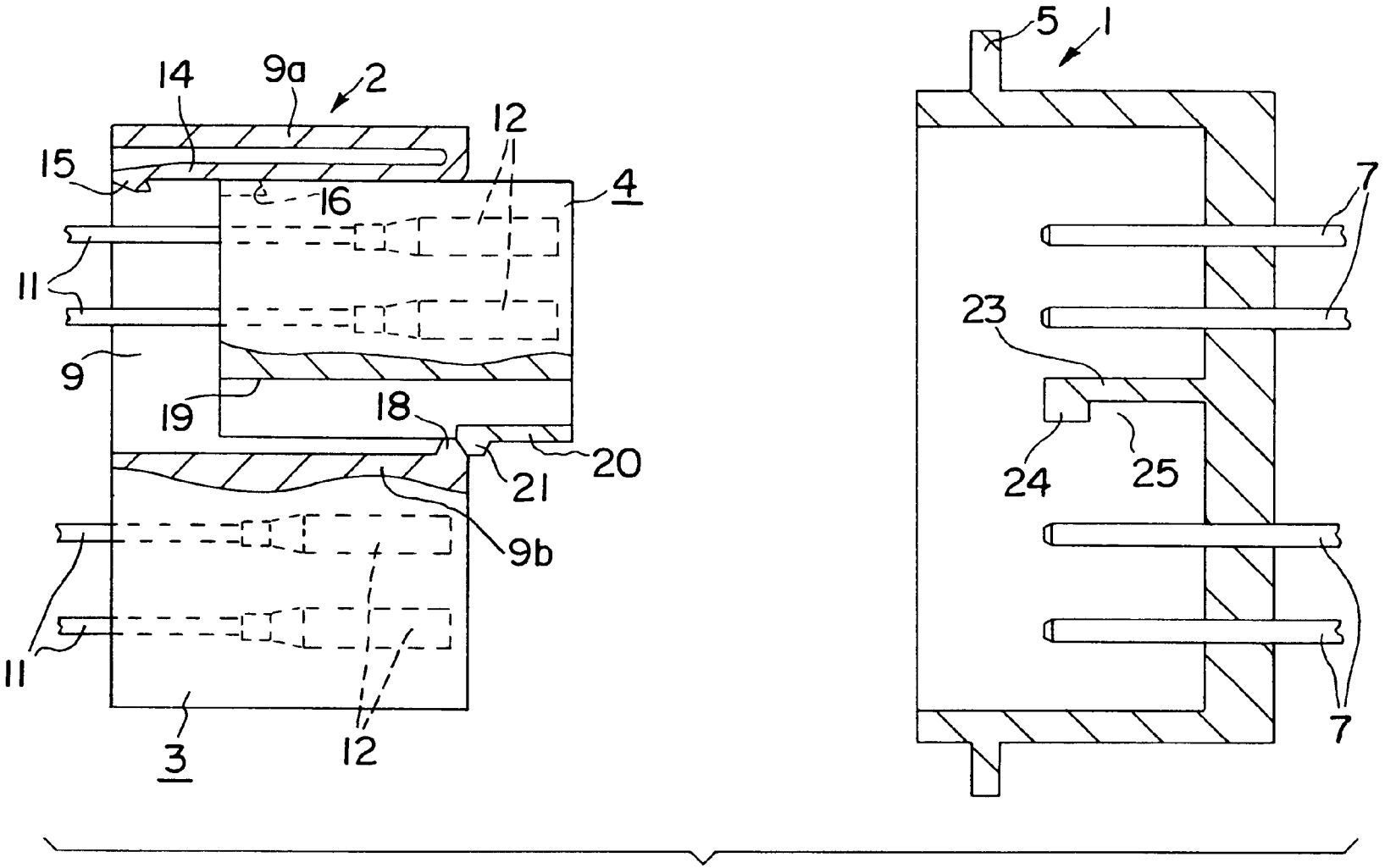
FIG. 2 is a section of male and female housings before the engagement.

On a side wall 9*a* of the accommodation space 9 of the main housing piece 3 at a side opposite from the side where the cavities 10 are formed, a lock member 14 is provided as shown in FIG. 2. The lock member 14 acts to hold the auxiliary housing piece 4 so as not to come out of the main housing piece 3 when the housing pieces 3, 4 are properly fitted into the male housing 1. More specifically, the lock member 14 has a hook 15 at its front end; extends backward from the front edge of the side wall 9*a*; and is elastically deformable in an outward direction. When the front surfaces of the main housing piece 3 and of the auxiliary housing piece 4 are in flush with each other, the hook 15 at the front end of the lock member 14 is engaged with a notch 16 formed in the rear surface of the auxiliary housing piece 4 (see FIG. 6) so as to lock the auxiliary housing piece 4, thereby preventing the auxiliary housing piece 4 from coming out of the main housing piece 3 in the backward direction.

In a side wall 9*b* of the accommodation space 9 of the main housing piece 3 where the cavities 10 are formed, a locking projection 18 having a substantially triangular cross section extends along the front edge (right side in FIG. 2) in a substantially center position with respect to a height direction. On the other hand, in a side surface of the auxiliary housing piece 4 corresponding to the side wall 9*b*, a guide groove 19 extending in forward and backward directions is formed in a substantially center position with respect to a height direction. A locking portion 20 is formed on the surface at the front end of the guide groove 19. The locking portion 20 is formed at its front end with a projection 21 having a substantially triangular cross section and engageable with the locking projection 18. The locking portion 20 projects backward, and its leading end is elastically deformable toward the bottom surface of the guide groove 19.

The auxiliary housing piece 4 is inserted into the accommodation space 9 of the main housing piece 3 from its rear surface while the lock member 14 is elastically deformed, and is pressed while the locking portion 20 is deformed. Where the auxiliary housing piece 4 projects from the front surface of the main housing piece 3 by a specified distance as shown in FIG. 2, the projection 21 of the locking portion 20 engages the locking projection 18, with the result that the auxiliary housing piece 4 is partly assembled such that it cannot come out of the main housing piece 3 in the backward direction. Therefore, the main housing piece 3 and the auxiliary housing piece 4 can integrally be fitted into the male housing 1.

The male housing 1 is formed with a projected portion 23 fittable into the guide groove 19 of the auxiliary housing piece 4. The projected portion 23 projects from the inner back surface of the male housing 1 in a position between the left and right areas, and is formed at its front end with a deformation preventing portion 24 bulging toward the right area. A deformation space 25 for permitting the deformation of the locking portion 20 is formed by a space behind the deformation preventing portion 24.

Figure 3:
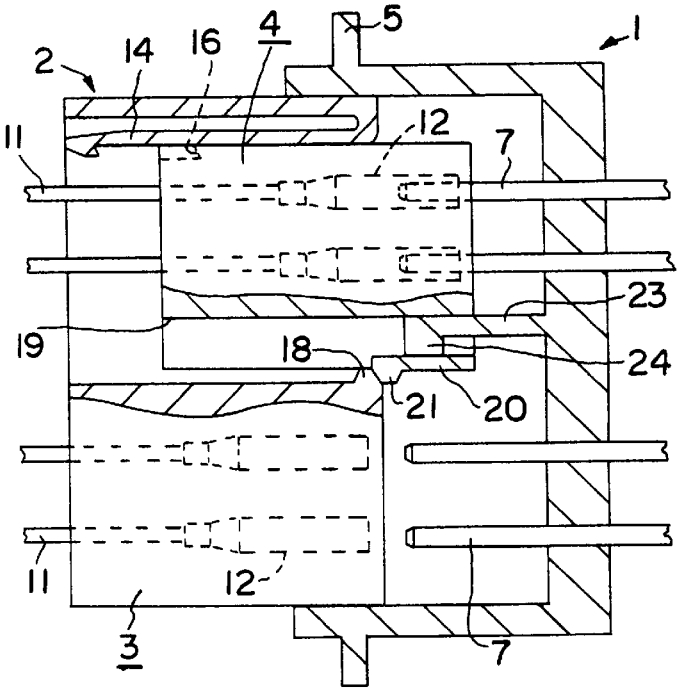
FIG. 3 is a section of the connector at the start of the engagement of an auxiliary housing piece.
Figure 4:
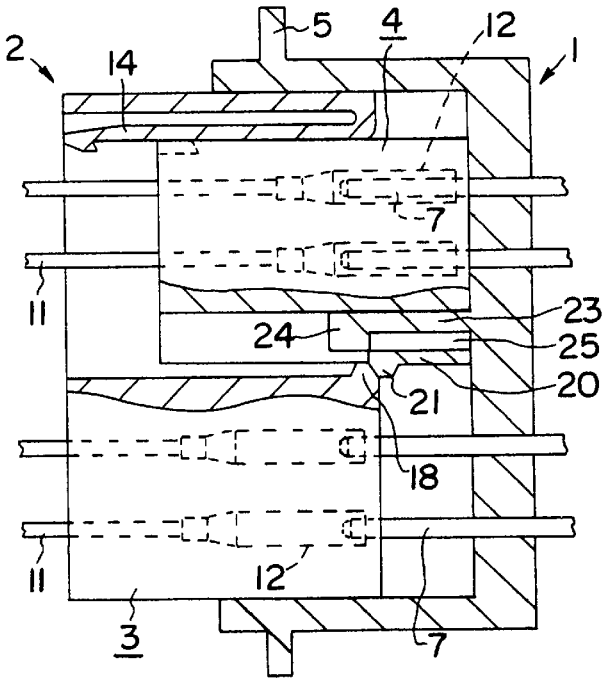
FIG. 4 is a section of the connector when the auxiliary housing piece is properly engaged.
Figure 5:
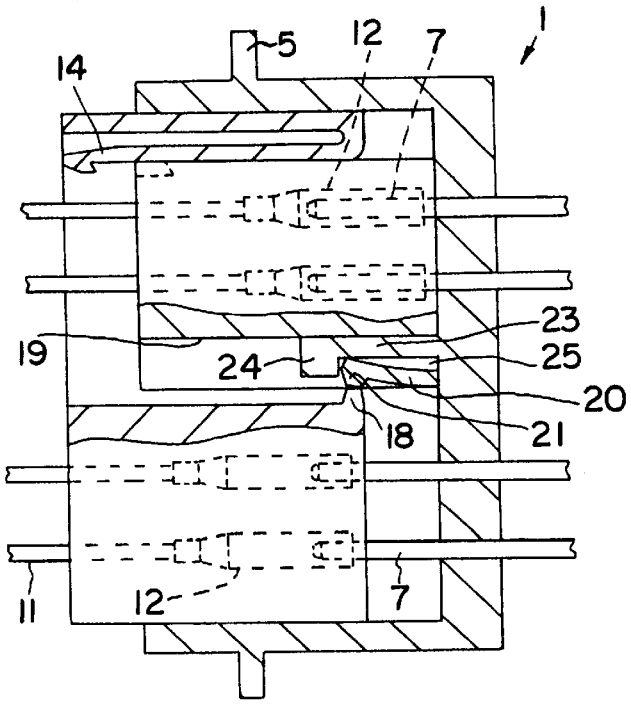
FIG. 5 is a section of the connector during the engagement of a main housing piece.

More specifically, when the auxiliary housing piece 4 is fitted into the left area of the male housing 1, the projected portion 23 relatively enters the guide groove 19 while the deformation preventing portion 24 slides along the rear surface of the locking portion 20 as shown in FIG. 3. During the entrance of the projected portion 23 into the guide groove 19, the deformation of the locking portion 20 is hindered by the deformation preventing portion 24 located at the rear side of the locking portion 20. On the other hand, when the auxiliary housing piece 4 is fitted to the inner back surface of the male housing 1, i.e. to a proper engagement position, the deformation preventing portion 24 comes before the leading end of the locking portion 20 as shown in FIG. 4, thereby permitting the deformation of the locking portion 20 toward the deformation space 25.

A locking construction for the main housing piece 3 and the male housing 1 is as follows. The lock arm 27 is provided on the ceiling surface of the mounting space 35 of the main housing piece 3 for the short-circuiting terminal 36. The lock arm 27 extends from the front end of the main housing piece 3 toward the rear end thereof, and the front end thereof where an operable portion 28 is formed is elastically deformable toward the mounting space 35. In a center portion of the upper surface of the lock arm 27 with respect to the longitudinal direction thereof, there is formed a locking projection 29 the front surface of which is a slanting surface 30.

On the other hand, in the upper surface of the male housing 1 where the lock arm 27 is fitted, an interrupted engagement groove 32 in which the locking projection 29 of the lock arm 27 is fittable is formed between the front edge as an engagement edge and a position slightly before the jaw portion 5 and between the rear surface of the jaw portion 5 and the rear edge. An interrupted portion of the engagement groove 32 projecting forward from the jaw portion 5 acts as a contact portion 33 with which the locking projection 29 comes into contact.

Figure 8:
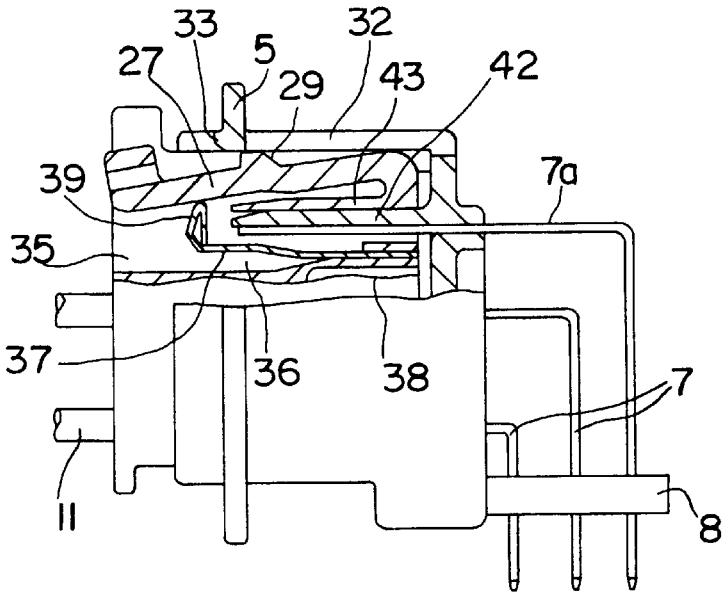
FIG. 8 is a side view partly in section of the connector when the main housing piece is insufficiently engaged.

Specifically, while the main housing piece 3 is fitted into the male housing 1, the slanting surface 30 of the locking projection 29 comes into contact with the contact portion 33, with the result that the lock arm 27 is pressed toward the mounting space 35 while undergoing a deformation as shown in FIG. 8. When the main housing piece 3 is fitted to the inner back surface of the male housing 1, i.e. to the proper engagement position, the locking projection 29 is located behind the jaw portion 5. Accordingly, the lock arm 27 is elastically restored while the locking projection 29 is fitted into the engagement groove 32. By engaging the locking projection 29 with the rear surface of the jaw portion 5, the main housing piece 3 is locked in the male housing 1.

When the operable portion 28 is pressed to deform the lock arm 27 in the above locked state, the locking projection 29 is disengaged from the jaw portion 5. In this state, the main housing piece 3 can be detached from the male housing 1 by being withdrawn.

Next, a construction for the electrical engagement detection which acts in association with the locking operation of the main housing piece 3 is described.

The short-circuiting terminal 36 is mounted in the mounting space 35 of the main housing piece 3. The short-circuiting terminal 36 is, as shown in FIG. 1, constructed such that the base ends of two spaced elastic contact portions 37 are connected by a connection plate 38 which also acts as a mount portion, and that press portions 39 stand at the leading ends of the elastic contact portions 37. The short-circuiting terminal 36 is mounted by inserting the connection plate 38 into a mount slot 41 formed in the bottom surface of the front end of the mounting space 35 as shown in FIG. 7. In this state, the elastic contact portions 37 are slanted gradually upward along a direction toward the back so that the leading ends thereof are elastically deformable downwardly. When the main housing piece 3 is fitted into the male housing 1, the two detection terminals **7*a* provided in the male housing 1 come to the upper surface of the leading ends of the elastic contact portions 37**.

Figure 9:
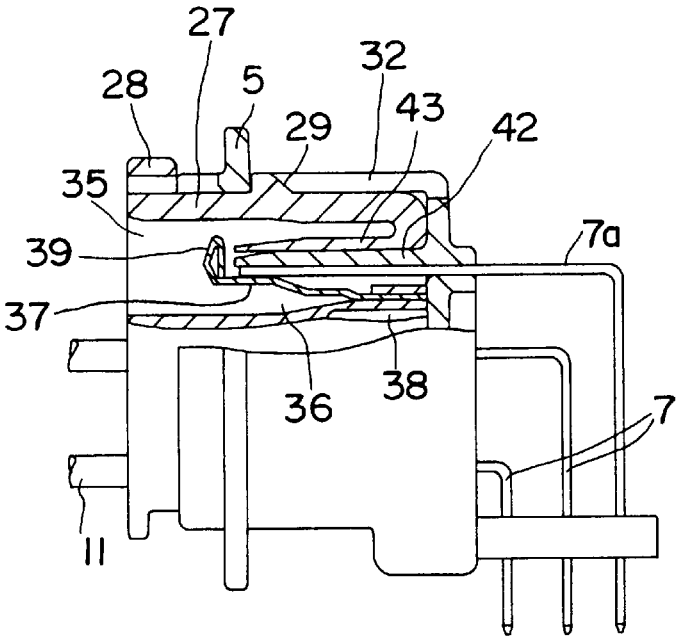
FIG. 9 is a side view partly in section of the connector when the main housing piece is properly engaged.

A receiving plate 42 for restricting the upward deformation of the detection terminals **7*a* projects from the inner back surface of the male housing 1 so as to be located on the upper surfaces of the detection terminals 7a. On the other hand, in the mounting space 35, a guide plate 43 for guiding the receiving plate 42 along its lower surface is so formed as to extend backward from the front edge. Specifically, when the main housing piece 3 is fitted to a position in the vicinity of the inner back surface of the male housing 1, the detection terminals 7*a* enter the mounting space 35 to the extent that they can come into contact with the elastic contact portions 37. However, the lock arm 27 is deformed downwardly to press the press portions 39, thereby deforming the elastic contact portions 37 downward as shown in FIG. 8. Accordingly, at this time, the detection terminals 7*a* and the elastic contact portions 37 are not in contact with each other. However, as shown in FIG. 9, when the lock arm 27 restores its original configuration after the main housing piece 3 is fitted to its proper engagement position, no force acts on the elastic contact portions 37, thereby allowing them to restore their original configurations. As a result, the elastic contact portions 37 press the corresponding detection terminals 7*a* against the receiving plate 42**.

Next, the operation of the thus constructed embodiment is described.

First, the short-circuiting terminal 36 is mounted in the mounting space 35 of the main housing piece 3 of the female housing 2 and the auxiliary housing piece 4 is accommodated into the accommodation space 9 such that the auxiliary housing piece 4 projects from the front surface of the main housing piece 3 as shown in FIG. 2. In this way, the main housing piece 3 and the auxiliary housing piece 4 are partly assembled. The thus assembled female housing 2 is pressed into the mating male housing 1.

When the female housing 2 is pressed into the male housing 1 to a certain extent, the projected portion 23 of the male housing 1 relatively enters the guide groove 19 while the deformation preventing portion 24 thereof slides along the rear surface of the locking portion 20. Since the deformation of the locking portion 20 is hindered by the deformation preventing portion 24 located at the rear side of the locking portion 20 during this time, the auxiliary housing piece 4 is fitted into the left area of the male housing 1 ahead of the main housing piece 3 while the locking portion 20 is pressed by the locking projection 18. As a result, the female terminal fittings 12 in the auxiliary housing piece 4 are fitted to the corresponding male terminal fittings 7.

When the female terminal 2 is further pressed, the auxiliary housing piece 4 reaches the inner back surface of the left area, i.e. is fitted to its proper engagement position as shown in FIG. 4. At this time, the deformation preventing portion 24 is located before the leading end of the locking portion 20, thereby allowing the locking portion 20 to be deformed toward the deformation space 25, i.e. releasing the partial lock. Although the male terminal fittings 7 start fitting into the female terminal fittings 12 in the main housing piece 3, a large fitting force is not necessary.

When the main housing piece 3 is further pressed in the state of FIG. 4, the locking projection 18 presses the projection 21, thereby deforming the locking portion 20 toward the deformation space 25. The main housing piece 3 moves with respect to the auxiliary housing piece 4, and the corresponding male and female terminal fittings 7, 12 are deeply engaged with each other. When the main housing piece 3 is pressed as above, the detection terminals 7*a* enter the mounting space 35 to the extent that they can come into contact with the elastic contact portions 37 of the short-circuiting terminal 36. At this timing, since the lock arm 27 is deformed toward the mounting space 35, thereby pressing the press portions 39 to deform the elastic contact portions 37 downward as described above, the detection terminals 7*a* and the elastic contact portions 37 are not yet in contact with each other.

When the locking projection 18 of the main housing piece 3 moves over the projection 21 of the locking portion 20, the locking portion 20 restores its original configuration.

Figure 6:
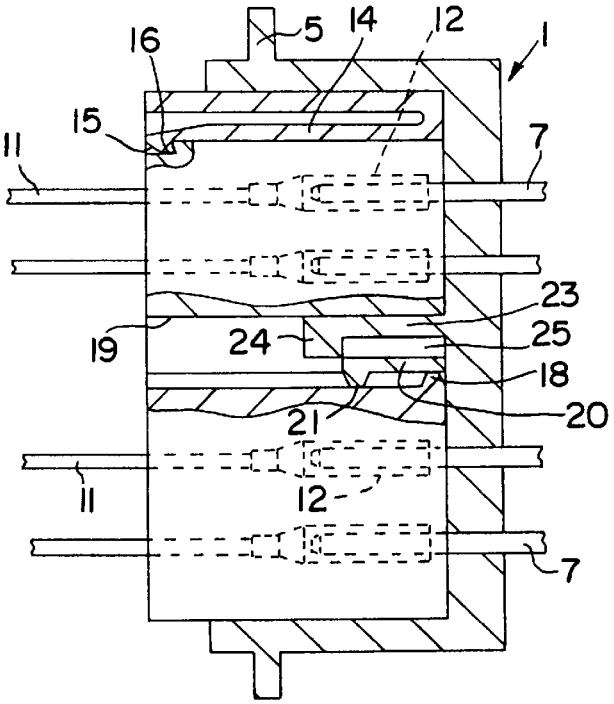
FIG. 6 is a section of the connector when the main housing piece is properly engaged.

When the main housing piece 3 reaches the inner back surface of the male housing 1, i.e. is properly engaged as shown in FIG. 6, the lock arm 27 restores it original configuration while the locking projection 29 is fitted into the engagement groove 32, and the locking projection 29 is engaged with the rear surface of the jaw portion 5 as shown in FIG. 9. As a result, the main housing piece 3 is locked in the male housing 1. Further, as shown in FIG. 6, the hook 15 of the lock member 14 provided at the main housing piece 3 is fitted into the notch 16 formed in the rear surface of the auxiliary housing piece 4, with the result that the auxiliary housing piece 4 is locked so as not to come out of the main housing piece 3.

When the lock arm 27 restores its original configuration as shown in FIG. 9 upon the proper engagement of the main housing piece 3, no pressing force acts on the elastic contact portions 37 of the short-circuiting terminal 36. Accordingly, the elastic contact portions 37 also restore their original configurations, and press the corresponding detection terminals 7*a* against the receiving plate 42. In this way, the detection terminals 7*a* are short-circuited by the short-circuiting terminal 36, thereby detecting the proper engagement of the main housing piece 3.

As described above, according to this embodiment, since the auxiliary housing piece 4 and the main housing piece 3 are successively fitted into the male housing 1, a small fitting force is required to engage the male and female housings 1, 2.

In addition, at the time when the engagement of the main housing piece 3 is started, the auxiliary housing piece 4 is already properly engaged. Accordingly, by making only a single detection as to whether the main housing piece 3 is properly engaged, the proper engagement of the housing pieces 3 and 4 can be detected. In other words, the number of parts can be reduced since it is sufficient to provide the short-circuiting terminal 36 only in the main housing piece 3, and the detection can be quickly made in one position. Accordingly, a production cost can be reduced. Further, since the main housing piece 3 and the auxiliary housing piece 4 can partly be assembled, this connector can easily be handle in transporting and engaging the male and female housings.

Hereafter, further embodiments of the invention are described with respect to the accompanying drawings.

Figure 10:
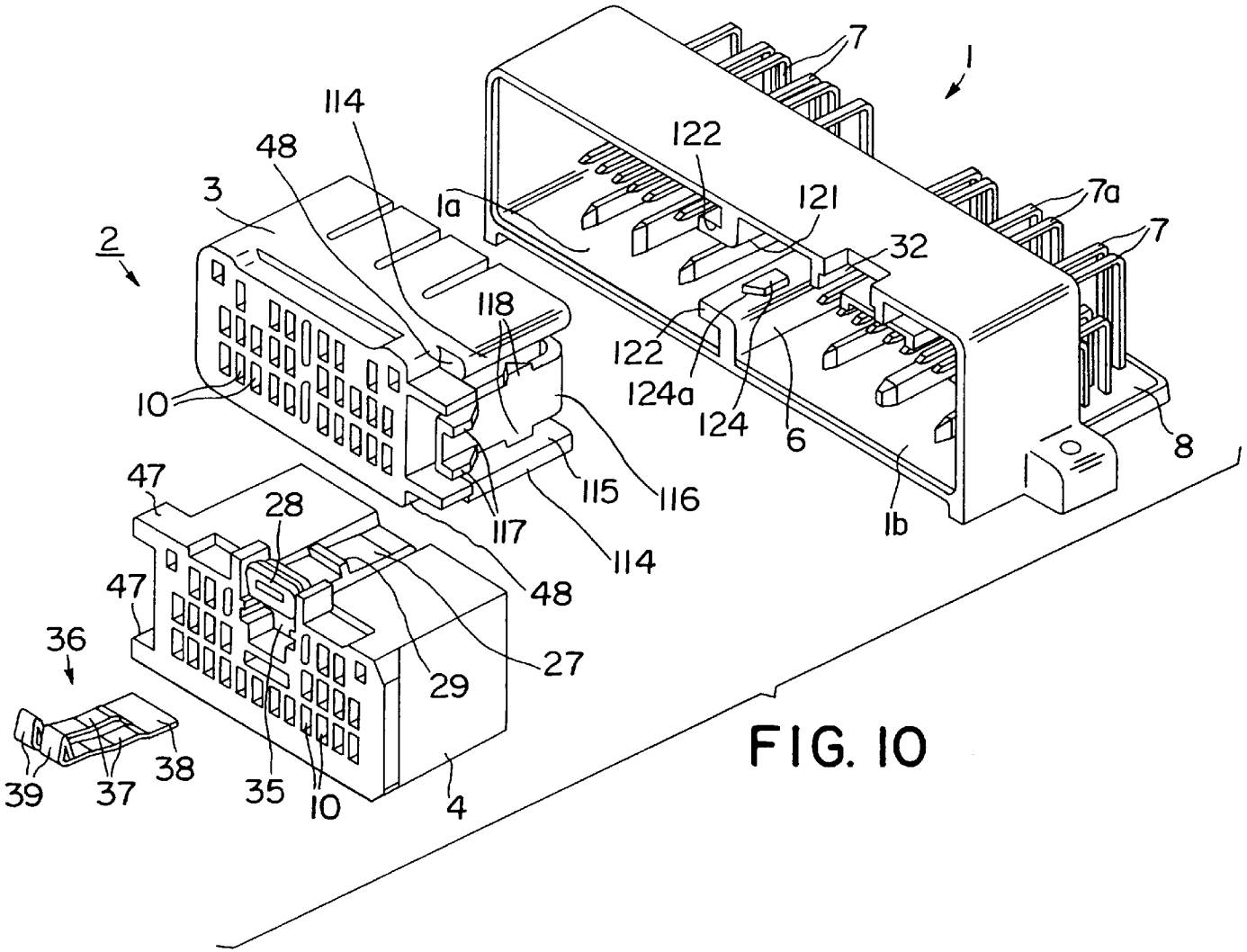
FIG. 10 is an exploded perspective view of a second embodiment of the invention.
Figure 18:
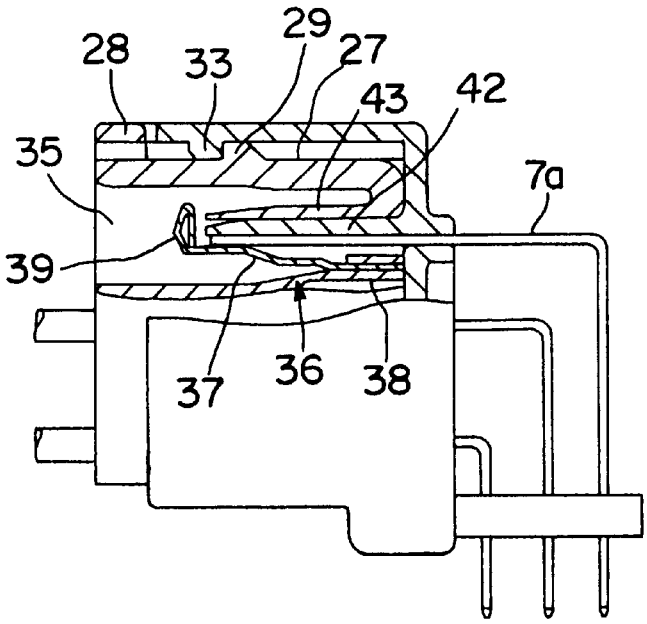
FIG. 18 is a side view partly in section when the second housing piece is properly engaged.

FIGS. 10 and 18 shows a second embodiment of the invention.

In this embodiment, a connector for a printed circuit board (PCB) is shown. As shown in FIG. 10, this connector includes a male connector housing 1 (hereafter, merely "male housing") to be connected with a printed wiring board and a female connector 2 (hereafter, merely "female housing") to be fitted into the male housing 1. The female housing 2 is divided into a first housing piece 3 and a second housing piece 4.

Figure 16:
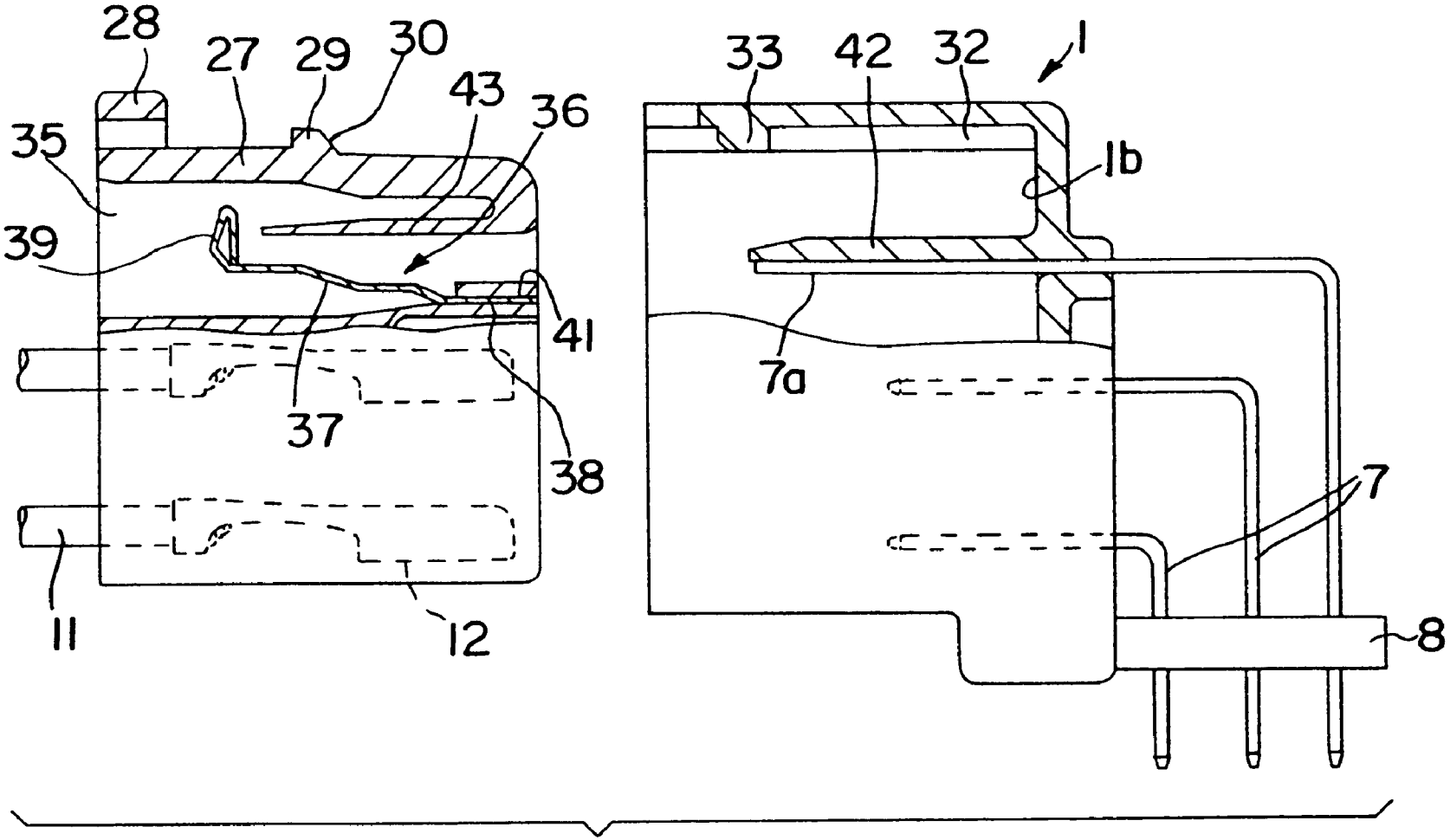
FIG. 16 is a side view partly in section showing a construction for the electrical detection.

The male housing 1 is made of synthetic resin into a laterally long boxlike shape having an open front surface at an engaging side. The inside of the male housing 1 is divided into left and right chambers 1*a*, 1*b* by a partition wall 6. In each of the chambers 1*a* and 1*b*, ends of a plurality of L-shaped male terminal fittings 7 in arrangement project from the inner back surface. The other ends of the respective male terminal fittings 7 project downward through an alignment plate 8 projecting at the bottom of the rear surface of the male housing 1 as shown in FIG. 16 so as to be connectable with contacts of an unillustrated printed wiring board. Two male terminal fittings in the middle of the uppermost row in the right chamber 1*b* act as detection terminals 7*a* for the engagement detection to be described in detail later.

The female housing 2 is similarly made of synthetic resin, and includes the first housing piece 3 and the second housing piece 4 as described above. The housing pieces 3, 4 are in the form of blocks fittable into the corresponding chambers 1*a*, 1*b* of the male housing 1. In each of the housing pieces 3, 4, there are formed an array of cavities 10 into which female terminal fittings 12 (see FIG. 16) secured to ends of wires 11 are inserted from the rear side to be accommodated therein. The respective female terminal fittings 12 in the first housing piece 3 are individually connectable with the corresponding male terminal fittings 7 in the left chamber la of the male housing 1, whereas the respective female terminal fittings 12 in the second housing piece 4 are individually connectable with the corresponding male terminal fittings 7 in the right chamber 1*b* except the detection terminals 7*a*.

In an upper portion of the second housing piece 4, there is formed a mounting space 35 for mounting a short-circuiting terminal 36. A lock arm 27 for locking the engagement of the second housing piece 4 and the male housing 1 is provided on the ceiling surface of the mounting space 35. The lock arm 27 is described later.

A groove 115 extending in forward and backward directions is defined by forming side walls 114 at the upper and lower edges of a side surface of the first housing piece 3 to be adjacent to the second housing piece 4. In the groove 115, a lock member 116 for locking the first housing piece 3 in the male housing 1 is provided. The lock member 116 is formed such that it extends from the front edge of the groove 115 toward the rear edge thereof and its free end or leading end is elastically deformable in an outward direction.

Figure 11:
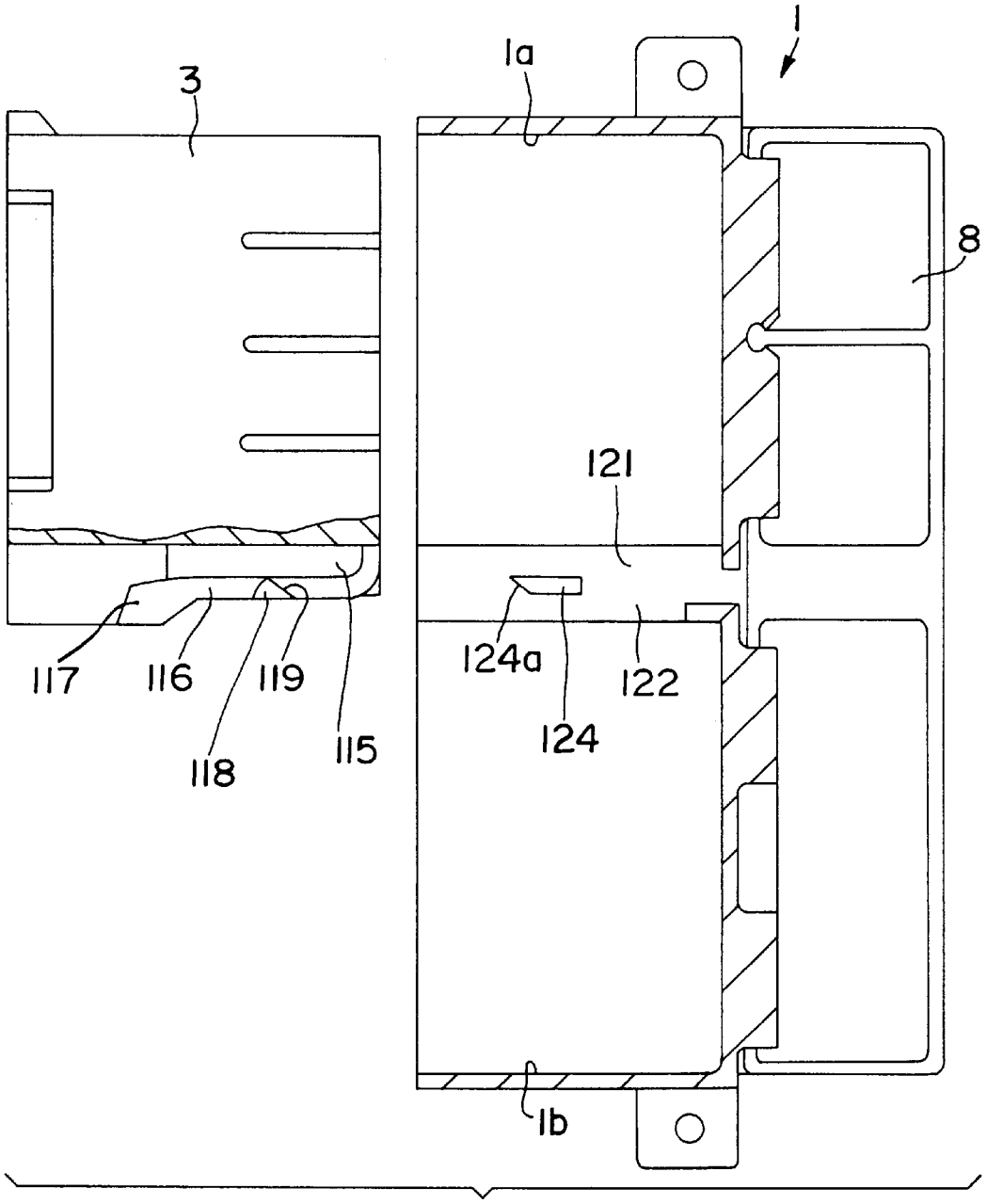
FIG. 11 is a plan view in section before the engagement of a first housing piece.
Figure 12:
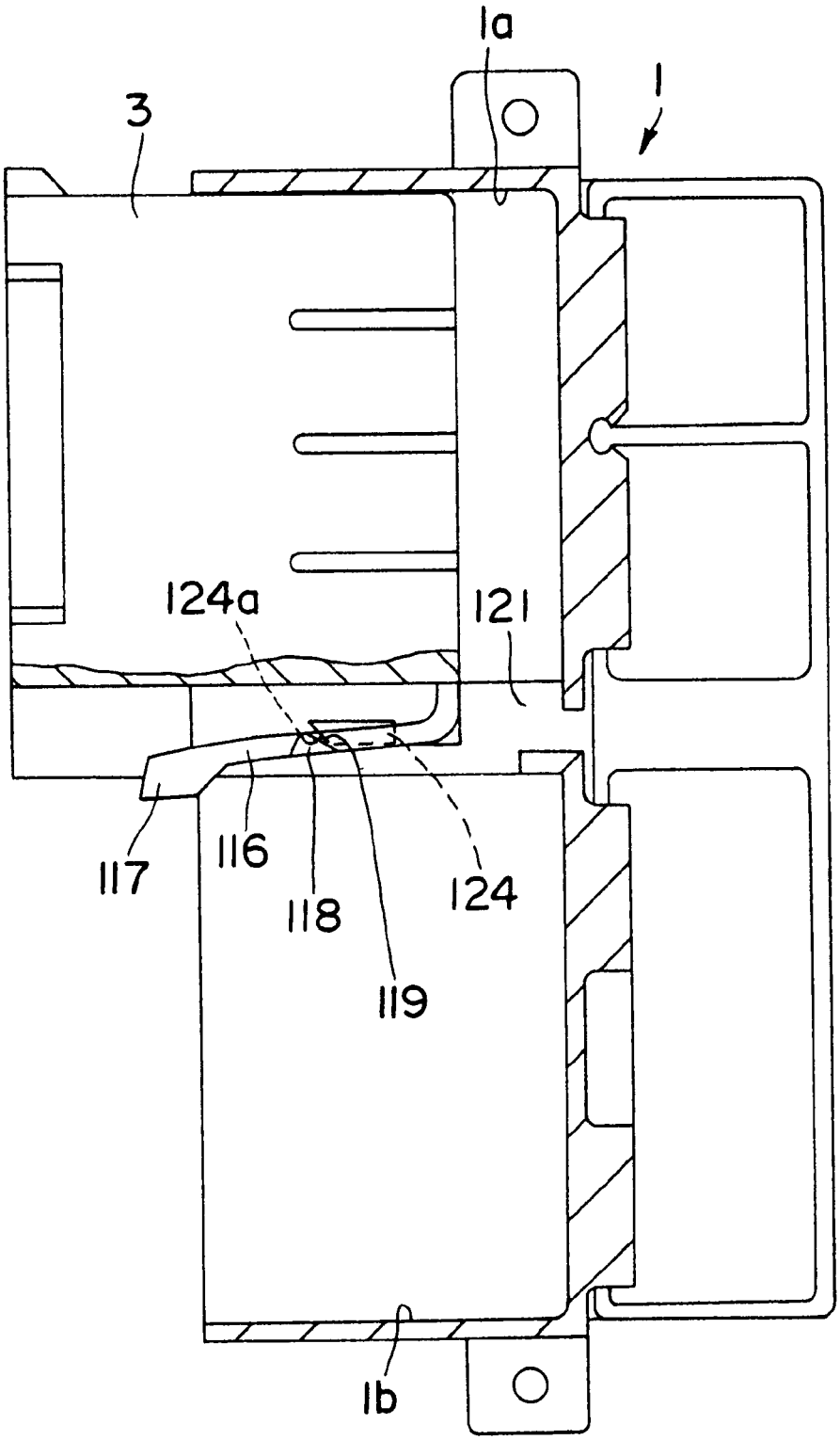
FIG. 12 is a plan view in section during the engagement of the first housing piece.

A pair of detection projections 117 are formed at the leading end of the lock member 116 by bending the opposite side edges substantially at right angles. A pair of locking projections 118 are provided in middle positions of the opposite side edges of the lock member 116 with respect to its longitudinal direction. An obliquely upward slanting surface 119 is formed at the locking projection 118 as shown in FIG. 11.

On the other hand, a groove 121 opening forward is formed in the partition wall 6 of the male housing 1, and two guide plates 122 project toward the left chamber 1*a* from the upper and lower edges of the groove 121. The first housing piece 3 is fitted by guiding the side walls 114 of the groove 115 fitted on the outer surfaces of the guide plates 122, and the lock member 116 is inserted into the groove 121. On the surfaces of the guide plates 122 opposite to each other, a pair of locking portions 124 with which the locking projections 118 of the lock member 116 come into contact are formed as shown in FIG. 11. Each locking portion 124 has a slanting surface 124*a* on its surface with which the corresponding locking projection 118 comes into contact.

Figure 13:
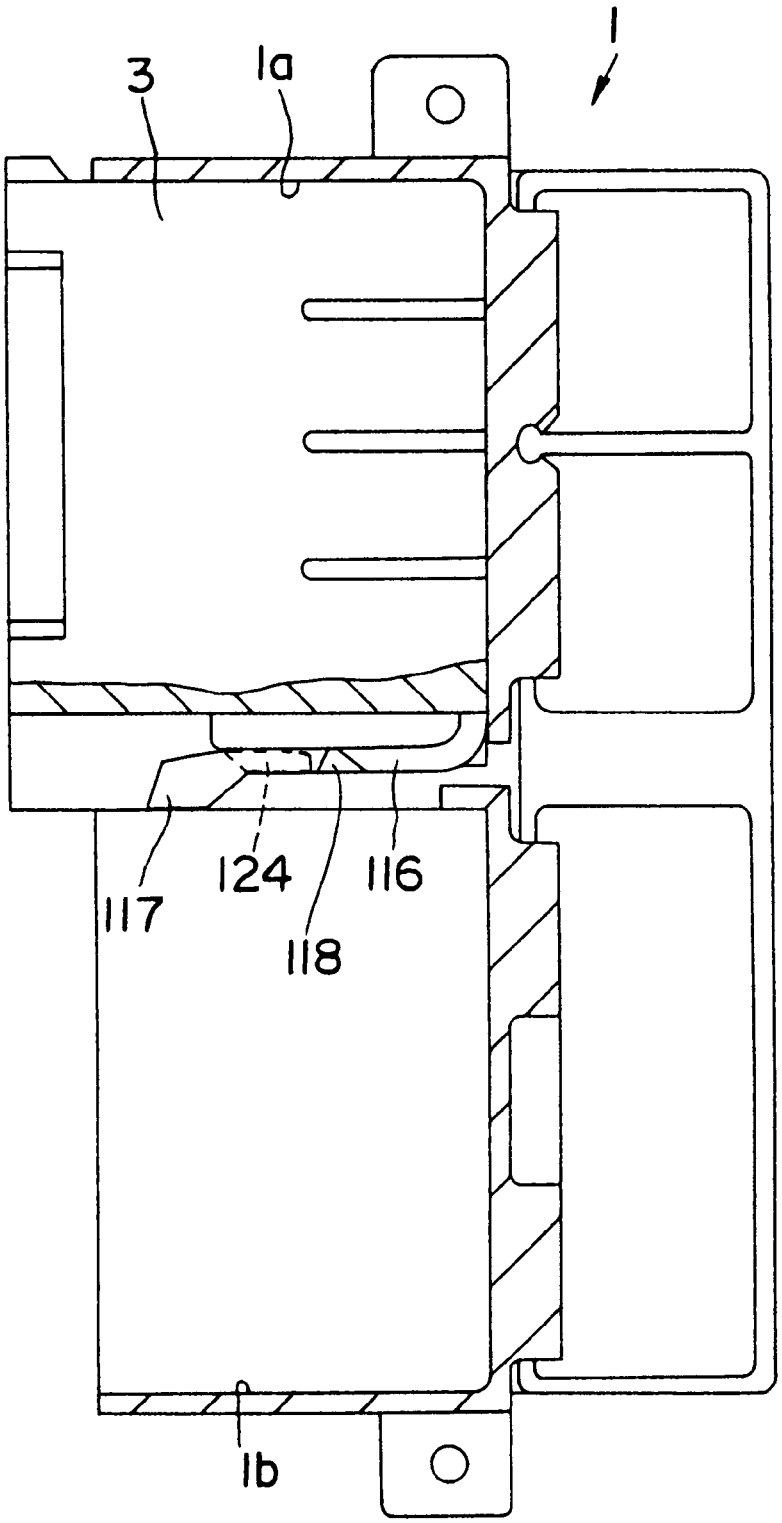
FIG. 13 is a plan view in section when the first housing piece is properly engaged.
Figure 14:
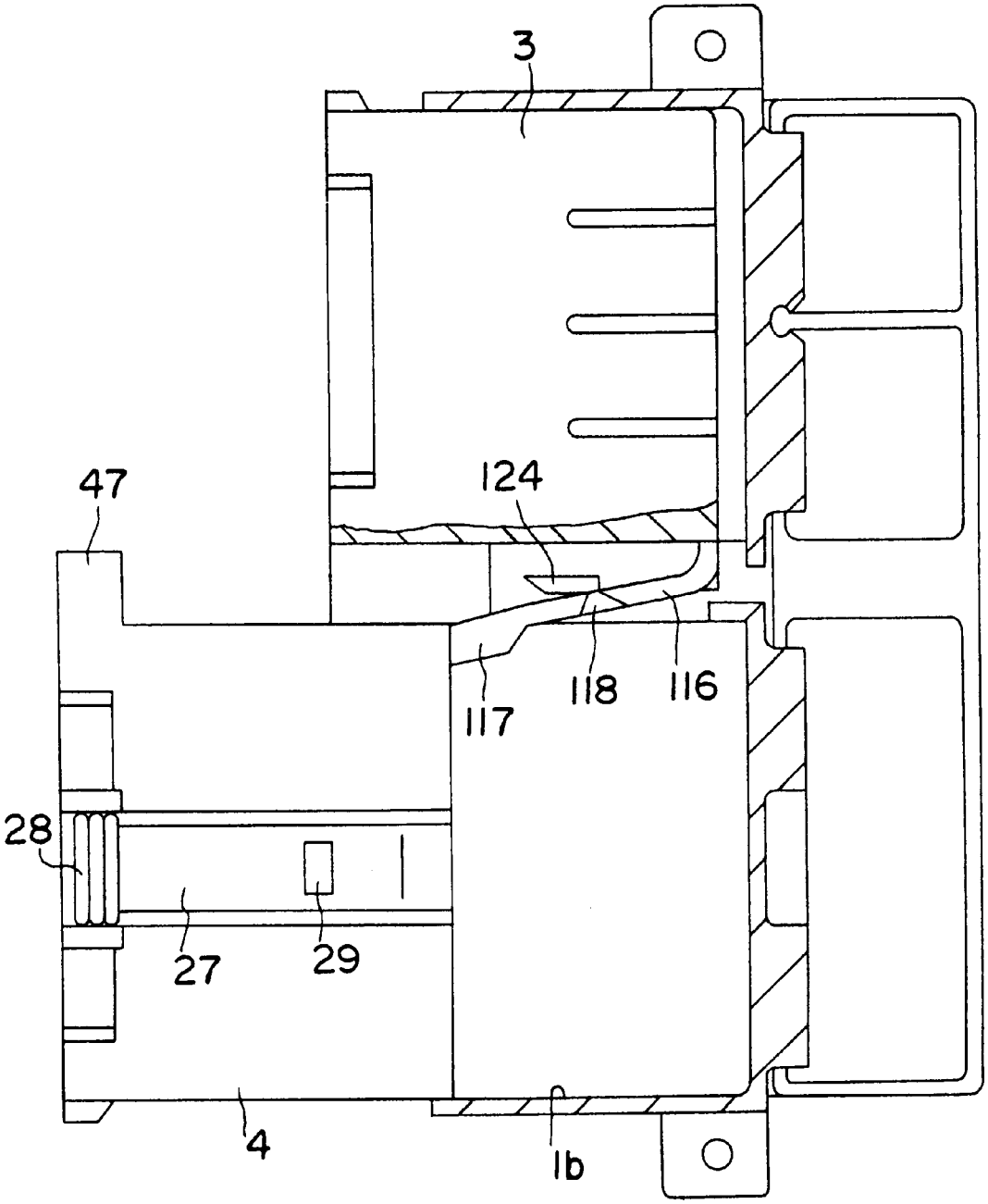
FIG. 14 is a plan view in section when the first housing piece is insufficiently engaged.

Specifically, while the first housing piece 3 is fitted into the left chamber la of the male housing 1, the lock member 116 enters the groove 121 in the partition wall 6. During the insertion of the lock member 116 into the groove 121, the surfaces 119 of the locking projections 118 come into contact with the locking portions 124, and the lock member 116 is elastically deformed outward while moving onto the locking portions 124 via the slanting surfaces 124*a*. At this time, the detection projections 117 at the leading end of the lock member 116 bulge into an engagement area of the second housing piece 4 to be described later. When the first housing piece 3 is pressed to the inner back surface of the left chamber 1*a*, i.e. to its properly engagement position, the locking projections 118 move beyond the locking portions 124. Accordingly, the lock member 116 elastically restores its original configuration, and the locking projections 118 are engaged with the rear surfaces of the locking portions 124 as shown in FIG. 13. Therefore, the first housing piece 3 is locked so as not to come out, and the detection projections 117 of the lock member 116 retract from the engagement area of the second housing piece 4.

On the other hand, the second housing piece 4 is fittable into the right chamber 1*b* of the male housing 1 as described above. A locking construction for the second housing piece 4 and the male housing 1 is as follows. The lock arm 27 is provided in the ceiling surface of the mounting space 35 for the short-circuiting terminal 36. The lock arm 27 extends backward from the front edge of the second housing piece 4, and its leading end where an operable portion 28 is formed is elastically deformable toward the mounting space 35. In a center portion of the upper surface of the lock arm 27 with respect to its longitudinal direction, a locking projection 29 the front surface of which is a slanting surface 30 is formed.

An engagement groove 32 opening forwardly is formed in the ceiling surface of the right chamber 1*b* of the male housing 1 where the lock arm 27 is to be fitted. In the ceiling surface of the engagement groove 32, there is formed a locking portion 33 with which the locking projection 29 of the lock arm 27 comes into contact as shown in FIG. 16. A front end portion of the engagement groove 32 is cut away so that the operable portion 28 of the lock arm 27 is fittable.

Figure 17:
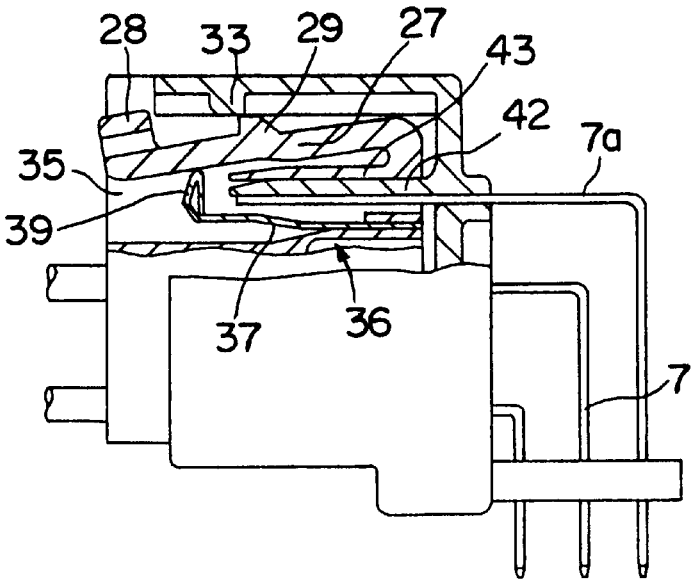
FIG. 17 is a side view partly in section when the second housing piece is insufficiently engaged.

Specifically, while the second housing piece 4 is fitted into the right chamber 1*b* of the male housing 1, the slanting surface 30 of the locking projection 29 comes into contact with the locking portion 33. Accordingly, the second housing piece 4 is pressed into the right chamber 1*b* while the lock arm 27 is elastically deformed toward the mounting space 35 as shown in FIG. 17. When the second housing piece 4 is pressed to the inner back surface of the right chamber 1*b*, i.e. to its proper engagement position, the locking projection 29 moves beyond the locking portion 33. Then, as shown in FIG. 18, the lock arm 27 elastically restores its original configuration and the locking projection 29 is engaged with the rear surface of the locking portion 33. As a result, the second housing piece 4 is locked so as not to come out.

If the lock arm 27 is deformed by pressing the operable portion 28 in the above locked state, the locking projection 29 is disengaged, and the second housing piece 4 can be detached from the male housing 1 by being withdrawn.

Next, a construction for the electrical engagement detection which acts in association with the locking operation of the second housing piece 4 is described.

The short-circuiting terminal 36 is mounted in the mounting space 35 of the second housing piece 4. The short-circuiting terminal 36 is, as shown in FIG. 10, constructed such that the base ends of two spaced elastic contact portions 37 are connected by a connection plate 38 which also acts as a mount portion, and that press portions 39 stand at the leading ends of the elastic contact portions 37. The short-circuiting terminal 36 is mounted by inserting the connection plate 38 into a mount slot 41 formed in the bottom surface of the front end of the mounting space 35 as shown in FIG. 16. In this state, the elastic contact portions 37 are slanted gradually upward along a direction toward the back so that the leading ends thereof are elastically deformable downward. When the second housing piece 4 is fitted into the right chamber 1*b* of the male housing 1, the two detection terminals 7*a* provided in the right chamber 1*b* come to the upper surface of the leading ends of the elastic contact portions 37.

A receiving plate 42 for restricting the upward deformation of the detection terminals 7*a* projects from the inner back surface so as to be located on the upper side of the detection terminals 7*a*. On the other hand, in the mounting space 35, a guide plate 43 for guiding the receiving plate 42 along its lower surface is so formed as to extend backward from the front edge. Specifically, when the second housing piece 4 is fitted to a position in the vicinity of the inner back surface of the right chamber 1*b*, the detection terminals 7*a* enter the mounting space 35 to the extent that they can come into contact with the elastic contact portions 37. However, at this time, the lock arm 27 is deformed downward to press the press portions 39 of the short-circuiting terminal 36, thereby deforming the elastic contact portions 37 downward as shown in FIG. 17. Accordingly, the detection terminals 7*a* and the elastic contact portions 37 are not yet in contact with each other. However, as shown in FIG. 18, when the lock arm 27 restores its original configuration after the second housing piece 4 is fitted to its proper engagement position, no more force acts on the elastic contact portions 37, thereby allowing them to restore their original configurations. As a result, the elastic contact portions 37 press the corresponding detection terminals 7*a* against the receiving plate 42.

Figure 15:
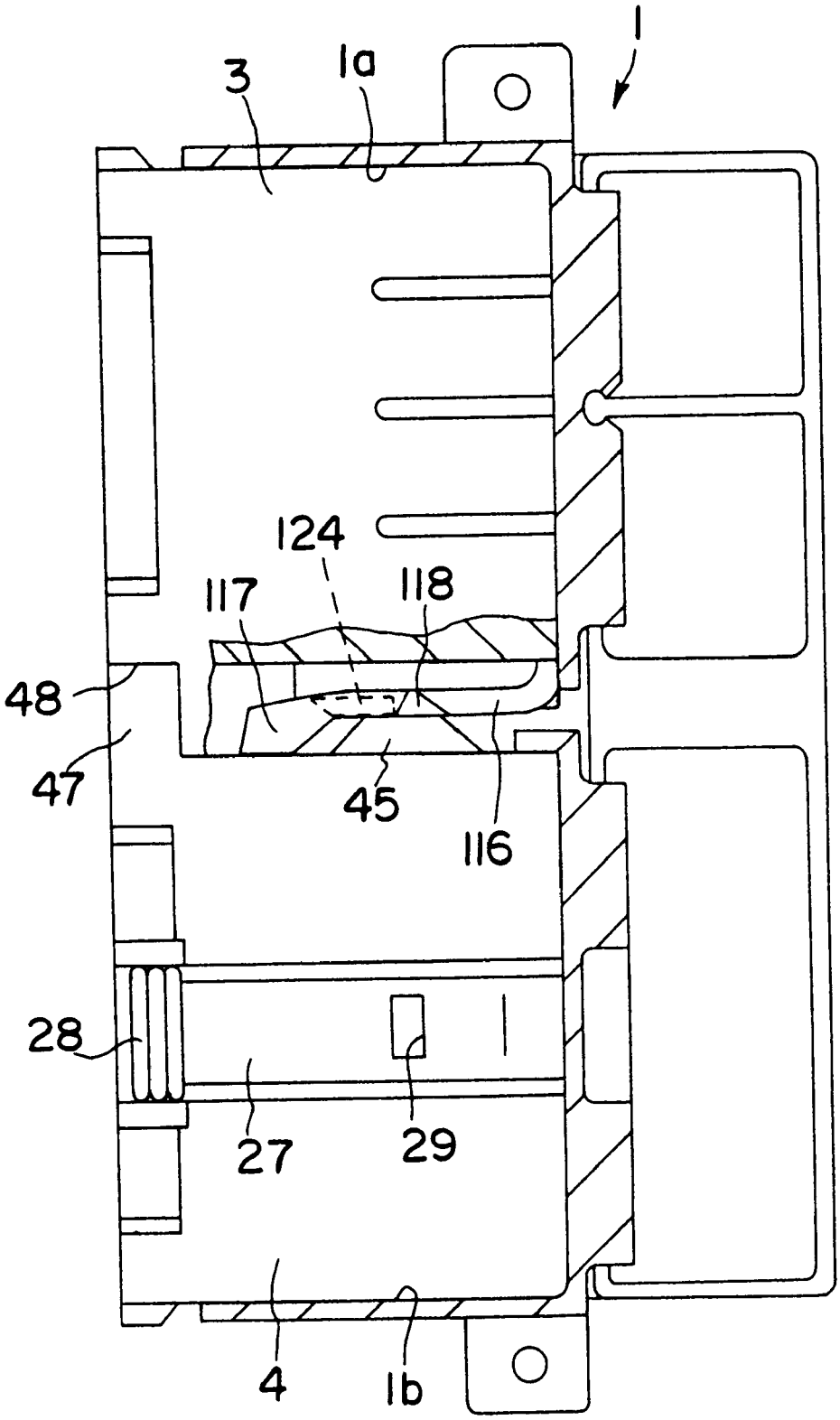
FIG. 15 is a plan view in section when a second housing piece is properly engaged.

A deformation preventing portion 45 projects at a side surface of the second housing piece 4 to be adjacent to the first housing piece 3. The deformation preventing portion 45 is located outside the lock member 116 as shown in FIG. 15 when the second housing piece 4 is properly engaged following the first housing piece 3, thereby preventing the elastic deformation of the lock member 3 in the outward direction. Further, a pair of pushing members 47 project from the upper and lower ends of the rear end of the same side surface of the second housing piece 4. The pushing members 47 are fittable into notches 48 formed at the rear end of the side walls 114 of the groove 115 of the first housing piece 3. When the second housing piece 4 is properly engaged following the first housing piece 3, the pushing members 47 are fitted into the notches 48 to press the first housing piece 3 so as not to be disengaged from the second housing piece 4.

Next, the operation of the second embodiment constructed as above is described.

First, the first housing piece 3 of the female housing 2 is fitted into the left chamber la of the male housing 1.

When the first housing piece 3 is pressed to a certain extent, the locking projections 118 of the lock member 116 come into contact with the locking portions 124 and move thereunto, with the result that the lock member 116 is elastically deformed outwardly and the detection projections 117 at the leading end of the lock member 116 bulge into the engagement area of the second housing piece 4. When the first housing piece 3 is further pressed to reach its proper engagement position, the lock member 116 elastically restores its original configuration; the locking projections 118 are engaged with the locking portions 124; and the first housing piece 3 is locked in the left chamber 1*a* so as not to come out. Simultaneously, since the detection projections 117 of the lock member 116 retract from the engagement area of the second housing piece 4, the second housing piece 4 may successively be fitted into the right chamber 1*b*.

If the first housing piece 3 is only insufficiently engaged during the above operation, the lock member 116 is left deformed outwardly and the detection projections 117 are left bulging into the engagement area of the second housing piece 4. Accordingly, if the second housing piece 4 is successively fitted in this state, the front end surface thereof comes into contact with the detection projections 117 of the lock member 116 and pushes them, thereby pressing the first housing piece 3 further into the left chamber 1*b*. When the first housing piece 3 is pressed to its proper engagement position, the lock member 116 elastically restores its original configuration and the detection projections 117 retract. Accordingly, only the second housing piece 4 is smoothly engaged thereafter.

When the second housing piece 4 is pressed into the right chamber 1*b*, the detection terminals 7*a* are inserted into the mounting space 35 to the extent that they can come into contact with the elastic contact portions 37 of the short-circuiting terminal 36 as shown in FIG. 17. In synchronism therewith, as described above, the lock arm 27 is elastically deformed toward the mounting space 35, thereby pressing the press portions 39 of the short-circuiting terminal 36 to deform the elastic contact portions 37 downward. Therefore, the detection terminals 7*a* and the elastic contact portions 37 are not yet in contact with each other.

When the second housing piece 4 reaches the inner back surface of the right chamber 1*b*, i.e. is properly engaged as shown in FIG. 15, the lock arm 27 elastically restores its configuration as shown in FIG. 18 and the locking projection 29 is engaged with the locking portion 33. As a result, the second housing piece 4 is locked in the right chamber 1*b*. Further, as shown in FIG. 15, the pushing members 47 provided at the second housing piece 4 are fitted into the notches 48 formed in the rear surface of the first housing piece 3, thereby locking the first housing piece 3 so as not to be disengaged from the second housing piece 4.

When the second housing piece 4 is properly engaged and the lock arm 27 restores its configuration as shown in FIG. 18, the elastic contact portions 37 to restore their original configurations since no more pressing force acts on the press portions 39 of the short-circuiting terminal 36, and press the corresponding detection terminals 7*a* against the receiving plate 42. As a result, the detection terminals 7*a* are short-circuited by the short-circuiting terminal 36, thereby detecting that the second housing piece 4 has properly been engaged.

As described above, according to this embodiment, only a small engaging force is required for engaging the male and female housings 1, 2 since the first and second housing pieces 3, 4 are successively engaged with the male housing 1.

If the first housing piece 3 is left insufficiently engaged, it is locked after being pressed to its proper engagement position via the deformed lock member 116 as the second housing piece 4 is fitted into the male housing 1. Accordingly, before the successive engagement of the second housing piece 4, the first housing piece 3 is already properly engaged. By making a single detection as to whether the second housing piece 4 is properly engaged, the proper engagement of both housing pieces 3, 4 can be detected. In other words, since it is sufficient to provide the short-circuiting terminal 36 only in the second housing piece 4, the number of parts can be reduced. Further, the detection can quickly be made in one position. Thus, a production cost can be reduced.

Figure 19:
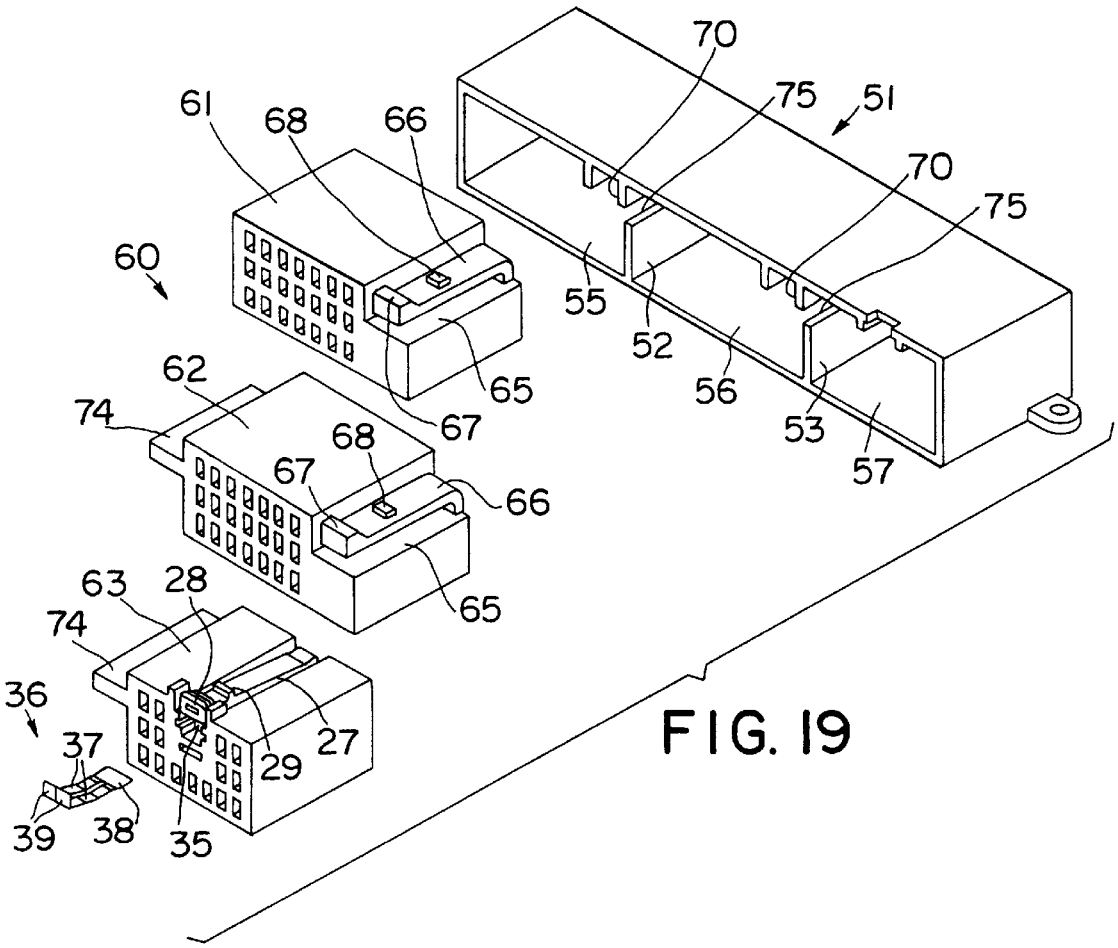
FIG. 19 is an exploded perspective view of a third embodiment of the invention.
Figure 20:
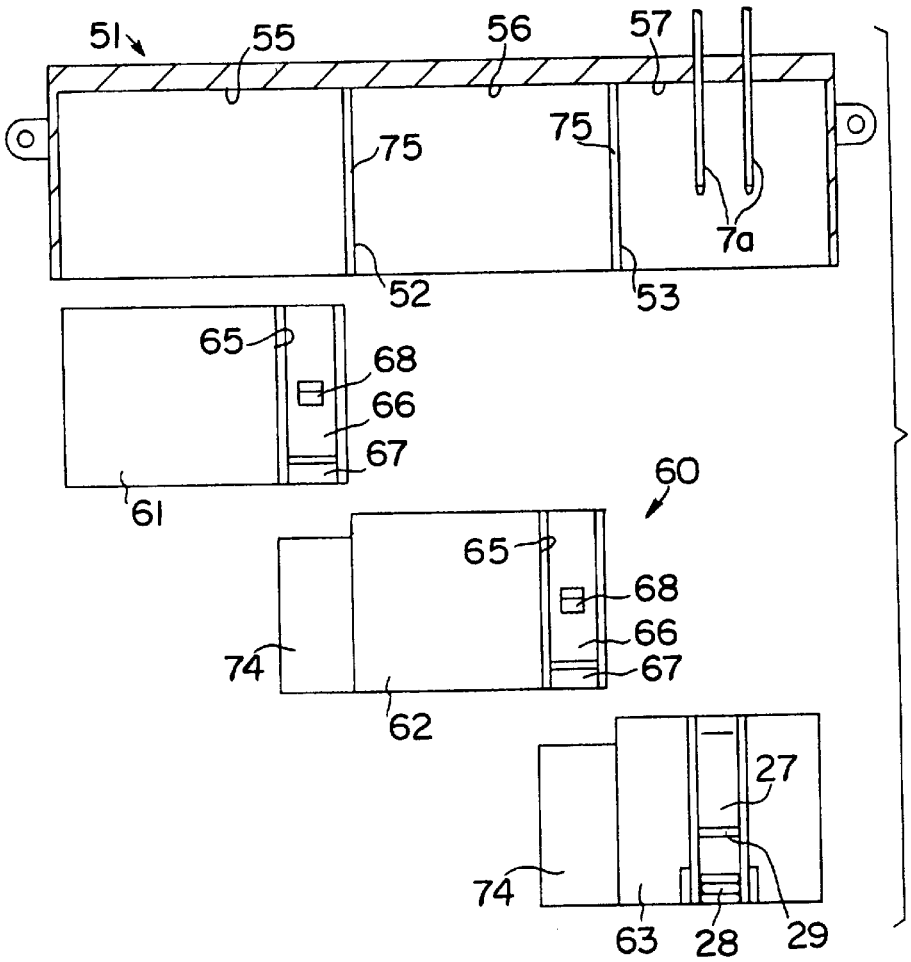
FIG. 20 is a plan view partly in section before the engagement of male and female housings.
Figure 21:
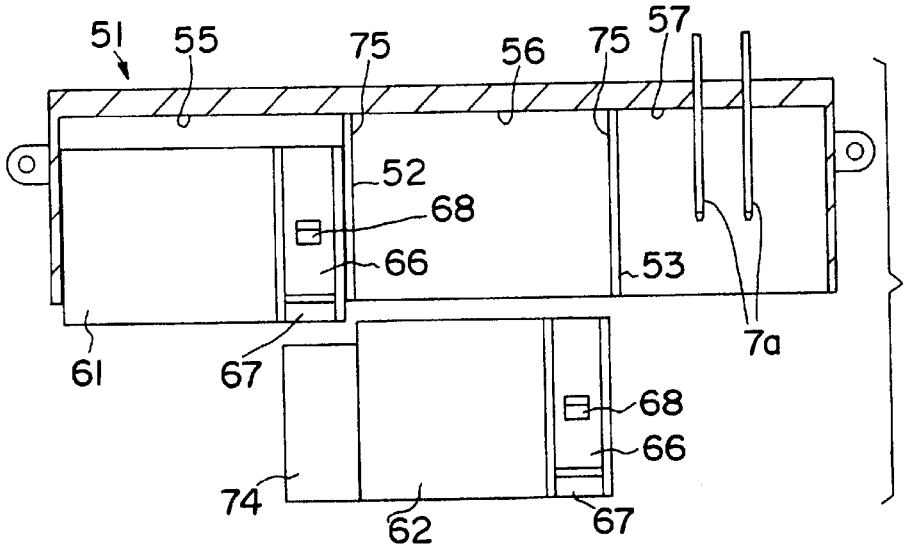
FIG. 21 is a plan view partly in section during the engagement of a first housing piece.
Figure 22:
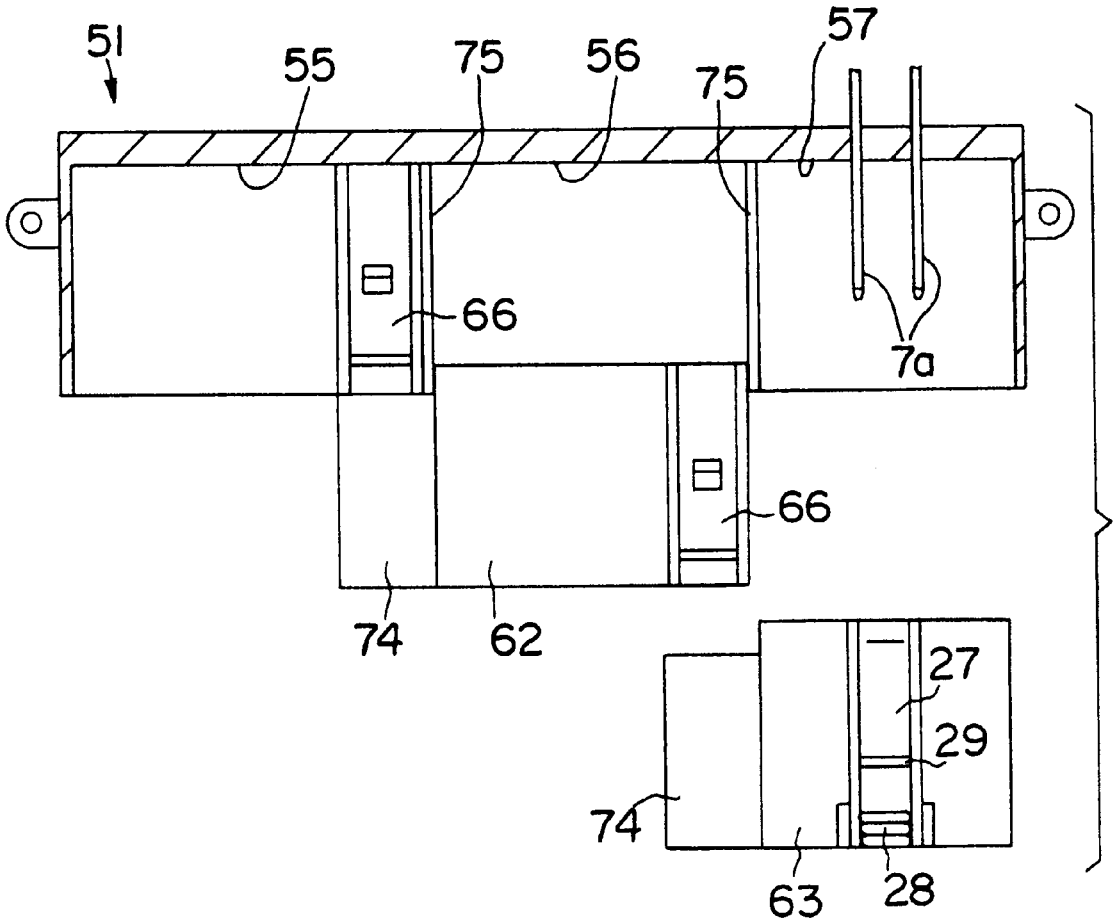
FIG. 22 is a plan view partly in section when the first housing piece is pressed to its proper engagement position.
Figure 23:
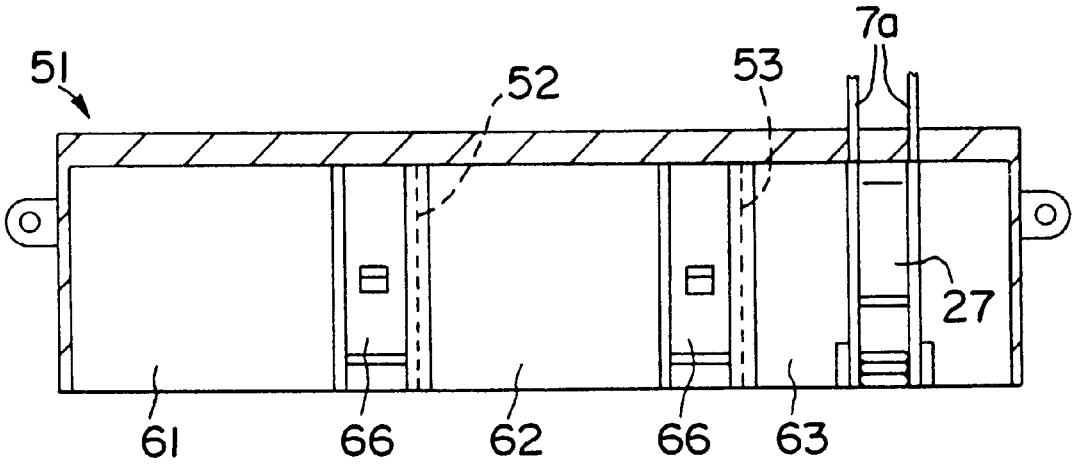
FIG. 23 is a plan view partly in section when all housing pieces are properly engaged.

FIGS. 19 to 25 show a third embodiment of the invention. In the third embodiment, as shown in FIGS. 19 and 11, a male housing 51 is made of synthetic resin into a laterally long boxlike shape having an open front surface. The inside of the male housing 1 is divided into three juxtaposed chambers 55 to 57 by partition walls 52, 53. A female housing 60 is divided into three pieces: first to third housing pieces 61 to 63 in this order from the left side in FIG. 20. The first to third housing pieces 61 to 63 are individually fittable into the chambers 55 to 57 of the male housing 1.

At a side of the first housing piece 61 to be adjacent to the second housing piece 62, an upper portion is lowered to form a stepped surface 65. On the stepped surface 65, there is provided a lock member 66 for locking the first housing piece 61 in the left chamber 55 of the male housing 1. The lock member 66 is so formed as to extend upwardly from the front edge of the stepped surface 65 and then to extend backwardly. A free end or leading end of the stepped surface 65 where a projection 67 is formed is elastically deformable downward. A locking projection 68 is provided in a middle position of the upper surface of the lock member 66 with respect to its longitudinal direction. At one side of the locking projection 68, an oblique slanting surface 69 is formed (see FIG. 24).

Figure 24:
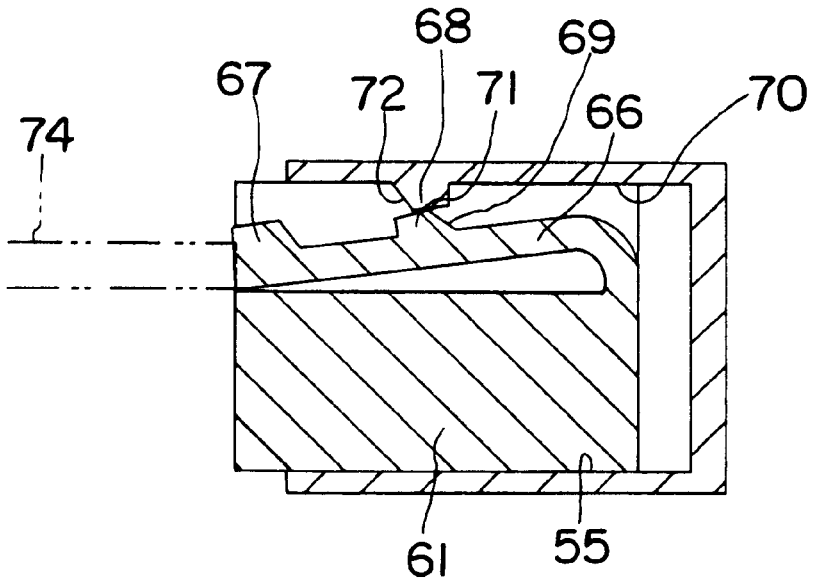
FIG. 24 is a section when the first housing piece is insufficiently engaged.

On the other hand, in the left chamber 55 of the male housing 51, a groove 70 opening forward is formed at the ceiling inwardly of the partition wall 52. As the first housing piece 61 is fitted into the left chamber 55, the lock member 66 enters the groove 70. As shown in FIG. 24, a locking portion 71 with which the locking projection 68 of the lock member 66 comes into contact is formed at the ceiling surface of the groove 70. A slanting surface 72 is formed at a surface with which the locking projection 68 comes into contact.

Figure 25:
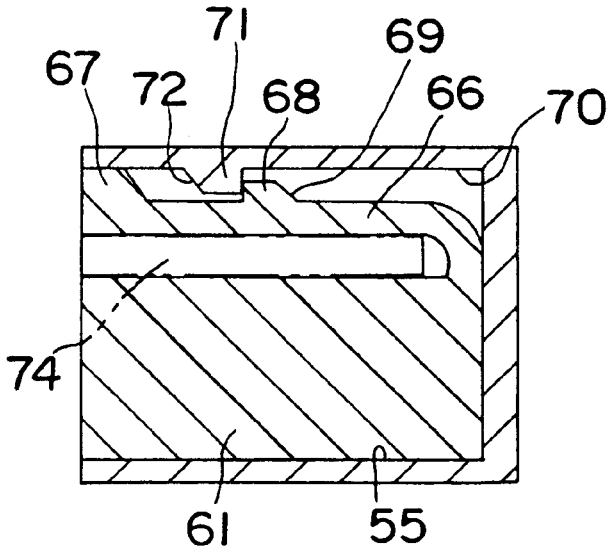
FIG. 25 is a section when the first housing piece is properly engaged.

More specifically, when the first housing piece 61 is fitted into the left chamber 55 of the male housing 51, the lock member 66 enters the groove 70. During the insertion of the lock member 66 into the groove 70, the slanting surface 69 of the locking projection 68 comes into contact with the locking portion 71 as shown in FIG. 24. The locking projection 68 moves onto the locking portion 71 via the slanting surface 72, thereby deforming the lock member 66 downward. When the first housing piece 61 is pressed to the inner back surface of the left chamber 55, i.e. to its proper engagement position, the locking projection 68 is beyond the locking portion 71. Accordingly, as shown in FIG. 25, the lock member 66 elastically restores its configuration and the locking projection 68 is engaged with the rear surface of the locking portion 71, with the result that the first housing piece 61 is locked so as not to come out.

A pushing member 74 projects at a side surface of the second housing piece 62 to be adjacent to the first housing piece 61. The pushing member 74 is insertable into an insertion groove 75 formed in the partition wall 52 while projecting into the left chamber 55 as the second housing piece 62 is fitted into the middle chamber 56 of the male housing 1. In the case that the first housing piece 61 has been properly engaged and the lock member 66 has elastically restored to its original configuration, the pushing member 74 can be inserted below the lock member 66 as shown in FIG. 25. In the case that the lock member 66 is deformed, the pushing member 74 comes into contact with the leading end of the lock member 66 as shown in FIG. 24. At a right side of the second housing piece 62, a lock member 66 similar to the one in the first housing piece 61 is provided. On the other hand, a pushing member 74 similar to the one in the first housing piece 61 projects at the left side surface of the third housing piece 63, and grooves 70, 75 similar to those as described above are formed at the right partition wall 53. Accordingly, the second housing piece 62 and the third housing piece 63 are joined in the same manner as the first housing piece 61 and the second housing piece 62 are joined.

In the third housing piece 63 and the right chamber 57 of the male housing 51, there are provided a locking mechanism for locking the third housing piece 63 in the right chamber 57 and an electrical engagement detecting mechanism. Since these two mechanisms are similar to those in the second embodiment, no repetitive description is given thereon by identifying them by the same reference numerals.

Next, the operation of the third embodiment is described. First, the first housing piece 61 of the female housing 60 is fitted into the left chamber 55 of the male housing 1. When the first housing piece 61 is pressed into the left chamber 55 to a certain extent, the locking projection 68 of the lock member 66 comes into contact with the locking portion 71 and moves thereunto as shown in FIG. 24, thereby elastically deforming the lock member 66 downward. As a result, the leading end of the lock member 66 bulges into an insertion area of the pushing member 74 in the second housing piece 62. When the first housing piece 61 is further pressed to reach its proper engagement position, the lock member 66 elastically restores its configuration and the locking projection 68 is engaged with the locking portion 71 as shown in FIG. 25. As a result, the first housing piece 61 is locked so as not to come out. Simultaneously, the leading end of the lock member 66 retracts from the insertion area of the pushing member 74. Accordingly, if the second housing piece 62 is successively fitted into the middle chamber 56, it is properly engaged with the pushing member 74 located below the lock member 66 as shown in FIG. 25.

If the first housing piece 61 is insufficiently engaged during the above operation, the lock member 66 is kept deformed downward, i.e. the leading end thereof is projecting into the insertion area of the pushing member 74. Therefore, when the second housing piece 62 is successively fitted, the pushing member 74 comes into contact with the leading end of the lock member 66 and pushes the first housing piece 61 into the left chamber 55. When the first housing piece 61 is pressed to its proper engagement position, the locking member 66 elastically restores its original configuration and retracts from the insertion area of the pushing member 74 as described above. Accordingly, only the second housing piece 62 can smoothly be engaged.

When the third housing piece 63 is fitted following the second housing piece 62, even if the second housing piece 62 is insufficiently engaged, the pushing member 74 of the third housing piece 63 pushes the deformed locking member 66 of the second housing piece 62 to securely press the second housing piece 62 to its proper engagement position in the same manner as described above.

Similar to the second embodiment, the engagement of the third housing piece 63 is electrically detected by a short-circuiting 36 and detection terminals 7a. Upon being properly engaged, the third housing piece 63 is locked via a lock arm 27 so as not to come out.

Since the first to third housing pieces 61 to 63 are successively engaged with the male housing 1 in the third embodiment as well, only a small engaging force is required. Further, even if the first housing piece 61 or the second housing piece 62 is left insufficiently engaged, the second housing piece 62 or the third housing piece 63 fitted subsequently presses the first housing piece 61 or the second housing piece 62 via the deformed lock member 66 so that the first housing piece 61 or the second housing piece 62 can be locked in its proper engagement position. Accordingly, before the engagement of the third housing piece 63, the first and second housing pieces 61, 62 are already properly engaged. Thus, by making a single detection as to whether the third housing piece 63 is properly engaged, the proper engagement of all housing pieces 61 to 63 can be detected. In other words, since it is sufficient to provide the short-circuiting terminal 36 only in the third housing piece 63, the number of parts can be reduced. Further, the detection can quickly be made in one position. Thus, a production cost can be reduced.

The present invention is not limited to the foregoing embodiment described above and shown in the drawings. For example, the following embodiments are embraced by the technical scope of the present invention, and a variety of other changes are possible without departing from the spirit and scope of the present invention.

(1) Although the connector of the type in which the main housing piece and the auxiliary housing piece can integrally be engaged while being partly assembled is shown in the foregoing embodiment, the present invention is similarly applicable to connectors of the type in which divided connector housings are individually successively engaged.

(2) The connector housing can be divided into two or more housing pieces.

(3) The present invention is also similarly applicable to connectors other than those for PCB, and the male housing may be divided contrary to the foregoing embodiment.

What is claimed is:

1. A connector comprising male and female connector housings each carrying a plurality of terminal fittings, one of the connector housings comprising a plurality of housing pieces including a first housing piece and at least one subsequent housing piece, said housing pieces being configured for engagement sequentially with a plurality of corresponding accommodation positions in the other connector housing, said connector comprising:] such that each said subsequent housing piece has at least one prior housing piece;

control means for preventing the engagement of each said subsequent housing piece until each said housing piece prior to the respective subsequent housing piece has been engaged, and a single detector for detecting whether a last of the housing pieces was properly engaged, and thereby also indicating whether each of said prior housing pieces was properly engaged.

2. A connector according to claim 1, wherein the control means are provided for pushing each said prior housing piece by a pushing force of said subsequent housing piece.

3. A connector according to claim 2, wherein the control means are provided between adjacent housing pieces.

4. A connector according to claim 2, further comprising an elastically deformable lock member at a side wall of at least one said prior housing piece adjacent to at least one said subsequent housing piece, the lock member being elastically deformable by moving onto a locking portion provided at the other connector housing as the prior housing piece is fitted; the lock member restoring its configuration and engaging the locking portion upon proper engagement of the prior housing piece; and, while being deformed by moving onto the locking portion, projects into an engagement area of the subsequent housing piece so as to be pressed by one of the subsequent housing pieces.

5. A connector according to claim 2, further comprising an elastically deformable lock member at a side wall of at least one said prior housing piece adjacent to one said subsequent housing piece, the lock member being elastically deformable by moving onto a locking portion provided at the other connector housing as the prior housing piece is fitted; the lock member restores its configuration to be engaged with the locking portion, projects into an engagement area of the subsequent housing piece so as to inhibit engagement of one of the subsequent housing piece.

6. A connector according to claim 2, wherein the housing pieces comprise an auxiliary housing piece that is engageable with a main housing piece and with the other connector housing, said main housing piece being engageable with the other connector housing, said auxiliary housing piece and said main housing piece being partly lockable with respect to each other and to said other connector housing, the control means permitting engagement of said auxiliary housing piece and of said main housing piece by releasing the partial lock only after the auxiliary housing piece and said main housing piece are properly engaged with each other and with said other connector housing.

7. A connector according to claim 2, wherein the housing pieces comprise an auxiliary housing piece that is movably provided in a main housing piece along a direction of engagement with the other connector housing and is partly lockable in a position with respect to the main housing piece relative to the direction of engagement, the control means permitting the engagement of the main housing piece by releasing the partial lock only after the auxiliary housing piece is properly engaged.

8. A connector according to claim 1, further comprising means for preventing unwanted self-locking during engagement of said housing pieces, and indexing means for preventing engagement of an unsuitable housing piece with the respective accommodation position.

9. An electrical connector assembly comprising:

an electrical connector having at least one receptacle formed therein;

a first mating connector selectively engageable in a first accommodation position in the receptacle of the electrical connector, said first mating connector having a first projection configured to be disposed in an engagement area of the receptacle before the first mating connector is properly engaged in the first accommodation position and to be disposed out of said engagement area when said first mating connector is properly engaged in the first accommodation position;

a second mating connector selectively engageable in a second accommodation position in the receptacle of the electrical connector, the second mating connector including a second projection extending into the engagement area when the second mating connector is properly engaged in the second accommodation position, such that the second mating connector is prevented from being properly engaged in the second accommodation position when the first projection is in the engagement area; and the connector assembly having a single detector for generating a signal when the second mating connector is properly engaged in the second accommodation position thereby also indicating that the first mating connector is properly engaged in the first accommodation position.

10. The electrical connector assembly of claim 9, wherein the electrical connector includes at least one projected portion disposed and configured for deflecting the first projection into the engagement area before the first mating connector is properly engaged in the first accommodation position, the projected portion of the electrical connector further being configured to permit the first projection to deflect out of the engagement area when the first mating connector is properly engaged in the first accommodation position.

11. The electrical connector assembly of claim 9, wherein the second projection is configured for exerting pushing forces on the first projection when the first projection is in the engagement area, the pushing forces of the second projection urging the first mating connector into proper engagement in the first accommodation position by urging the first projection out of the engagement area and enabling the second mating connector to be properly engaged in the second accommodation position.

12. An electrical connector assembly comprising:

an electrical connector having a housing with first through Nth accommodation positions formed therein, wherein N is a number greater than 2, each said accommodation position being substantially adjacent at least one other of said accommodation positions;

first through Nth mating connectors being selectively and sequentially engageable in the respective accommodation positions, first through (N−1)th of the mating connectors having blocking projections configured to be in an engagement area of the respective accommodation position before the respective mating connector is properly engaged in its accommodation position, each said blocking projection further being movable out of the respective engagement area when the respective mating connector is properly engaged in its accommodation position, each of the second through Nth mating connectors having pushing projections configured for extending into the engagement area of one said accommodation position adjacent thereto such that engagement of any said pushing projection with any of said blocking projections in any of said engagement areas prevents the respective mating connector and any subsequent ones of the mating connectors from being properly engaged in their accommodation positions, and wherein only the Nth mating connector includes an indicator disposed and configured for indicating when the Nth mating connector is properly engaged in its accommodation position, thereby indicating that the first through (N−1)th mating connectors also are properly engaged in their respective accommodation positions.

13. The electrical connector assembly of claim 12, wherein the electrical connector includes projected portions extending into each of at least the first through (N−1)th accommodation positions, the projected portions being disposed and configured for engaging and positioning the respective blocking projections in the respective engagement areas before the respective mating connectors are properly engaged in their accommodation positions.

14. The electrical connector assembly of claim 12, wherein each of said pushing projections is configured for engaging the blocking projection of the mating connector in the engagement area of an adjacent one of said accommodation positions for pushing an adjacent one of said mating connectors into proper engagement its respective accommodation position.

15. The electrical connector assembly of claim 12, wherein the indicator is a short circuit connector for generating a short circuit signal.

* * * * *